US010527348B2

(12) United States Patent
Yoshihara et al.

(10) Patent No.: US 10,527,348 B2
(45) Date of Patent: Jan. 7, 2020

(54) SUBSTRATE PROCESSING METHOD AND SUBSTRATE PROCESSING APPARATUS

(71) Applicant: SCREEN Holdings Co., Ltd., Kyoto (JP)

(72) Inventors: Naohiko Yoshihara, Kyoto (JP); Manabu Okutani, Kyoto (JP); Takashi Ota, Kyoto (JP); Hiroshi Abe, Kyoto (JP)

(73) Assignee: SCREEN Holdings Co., Ltd. (JP)

( * ) Notice: Subject to any disclaimer, the term of this patent is extended or adjusted under 35 U.S.C. 154(b) by 63 days.

(21) Appl. No.: 15/697,670

(22) Filed: Sep. 7, 2017

(65) Prior Publication Data

US 2018/0087836 A1 Mar. 29, 2018

(30) Foreign Application Priority Data

Sep. 26, 2016 (JP) ..... 2016-187248

(51) Int. Cl.
*F26B 3/20* (2006.01)
*F26B 9/10* (2006.01)
(Continued)

(52) U.S. Cl.
CPC ..... *F26B 3/20* (2013.01); *F26B 9/10* (2013.01); *F26B 3/04* (2013.01); *F26B 5/08* (2013.01); *F26B 11/08* (2013.01)

(58) Field of Classification Search
CPC ..... F26B 3/20; F26B 3/04; F26B 5/08; F26B 9/10; F26B 11/08
See application file for complete search history.

(56) References Cited

U.S. PATENT DOCUMENTS 7,021,319 B2 * 4/2006 Verhaverbeke ..... B08B 3/02 134/1
2007/0246079 A1 * 10/2007 Pham ..... H01L 21/67051 134/26

(Continued)

FOREIGN PATENT DOCUMENTS

JP 2000-091186 A 3/2000
JP 2010-56534 A1 3/2010

(Continued)

*Primary Examiner* — Sharidan Carrillo
(74) *Attorney, Agent, or Firm* — Ostrolenk Faber LLP

(57) ABSTRACT

A substrate processing method includes a substrate holding step of horizontally holding a substrate, a substrate rotating step of rotating the substrate held horizontally around a rotational axis along a vertical direction, a liquid-film forming step of forming a liquid film of a first organic solvent that is used to process an upper surface of the substrate on the upper surface of the substrate by supplying the first organic solvent to the upper surface of the substrate held horizontally, a vapor supplying step of supplying a vapor of a second organic solvent to a space between a facing surface of a heater unit that has the facing surface facing a lower surface of the substrate held horizontally and the lower surface of the substrate, a substrate heating step of heating the substrate being in a rotational state by means of the vapor of the second organic solvent in parallel with the substrate rotating step and the liquid-film forming step, and a substrate drying step of, after the substrate heating step, excluding the liquid film of the first organic solvent from the substrate held horizontally and drying the upper surface of the substrate in a state in which the rotation of the substrate is stopped and the substrate is in contact with the heater unit.

7 Claims, 12 Drawing Sheets

(51) Int. Cl.

| | |
|---|---|
| *F26B 3/04* | (2006.01) |
| *F26B 11/08* | (2006.01) |
| *F26B 5/08* | (2006.01) |

(56) References Cited

U.S. PATENT DOCUMENTS

| | | | | |
|---|---|---|---|---|
| 2010/0146813 | A1* | 6/2010 | Jeong | H01L 21/02057 34/519 |
| 2011/0155177 | A1 | 6/2011 | Tamura et al. | 134/18 |
| 2014/0065295 | A1* | 3/2014 | Emoto | B05D 1/005 427/8 |
| 2014/0127908 | A1 | 5/2014 | Okutani | 438/694 |
| 2014/0273498 | A1* | 9/2014 | Kobayashi | H01L 21/6708 438/745 |
| 2015/0093905 | A1 | 4/2015 | Fujiwara et al. | 438/745 |
| 2015/0270146 | A1 | 9/2015 | Yoshihara et al. | 134/18 |
| 2015/0279708 | A1 | 10/2015 | Kobayashi et al. | 438/747 |
| 2016/0025409 | A1* | 1/2016 | Miyazaki | F26B 3/28 34/274 |
| 2016/0089696 | A1 | 3/2016 | Kimura | 427/299 |
| 2016/0214148 | A1 | 7/2016 | Okutani et al. | 134/19 |
| 2017/0287769 | A1* | 10/2017 | Ota | H01L 21/68742 |
| 2018/0087836 | A1* | 3/2018 | Yoshihara | F26B 3/20 |

FOREIGN PATENT DOCUMENTS

| | | | |
|---|---|---|---|
| JP | 2014-112652 | A | 6/2014 |
| JP | 2016-136599 | | 7/2016 |
| KR | 10-2015-0035388 | A | 4/2015 |

* cited by examiner

SUBSTRATE PROCESSING METHOD AND SUBSTRATE PROCESSING APPARATUS

BACKGROUND OF THE INVENTION

1. Field of the Invention

The present invention relates to a substrate processing method and a substrate processing apparatus for processing a substrate. Examples of substrates to be processed include semiconductor wafers, substrates for liquid crystal displays, substrates for plasma displays, substrates for FEDs (Field Emission Displays), substrates for optical disks, substrates for magnetic disks, substrates for magneto-optical disks, substrates for photomasks, ceramic substrates, substrates for solar cells, etc.

2. Description of the Related Art

In substrate processing performed by a single substrate processing type substrate processing apparatus that processes a substrate one by one, for example, a chemical solution is supplied to the substrate that is held substantially horizontally by means of a spin chuck. Thereafter, a rinse liquid is supplied to the substrate, and the chemical solution on the substrate is thereby replaced with the rinse liquid. Thereafter, a spin drying step is performed to remove the rinse liquid on the substrate.

When a pattern is formed on a front surface of the substrate as shown in FIG. 9, there is a possibility that the rinse liquid that has entered the inside of the pattern cannot be eliminated in the spin drying step. Accordingly, there is a possibility that a drying failure will occur. A liquid surface (an interface between air and liquid) of the rinse liquid that has entered the inside of the pattern is formed in the inside of the pattern. Therefore, the surface tension of the liquid acts on contact positions between the liquid surface and the pattern. If the surface tension is high, a pattern collapse will occur easily. Water, which is a typical rinse liquid, is high in surface tension. Therefore, the pattern collapse in the spin drying step is not negligible.

Therefore, the employment of a method that uses isopropyl alcohol (IPA), which is an organic solvent having lower surface tension than water, is conceivable. In detail, the water that has entered the inside of the pattern is replaced with IPA by supplying the IPA to an upper surface of the substrate. The water that has entered the inside of the pattern is replaced with the IPA, and then the IPA is eliminated from the upper surface of the substrate, and, as a result, the upper surface of the substrate is dried. This lessens a pattern collapse resulting from surface tension. Additionally, in order to restrain a pattern collapse, it is also conceivable that surface tension that the pattern undergoes is reduced by processing the upper surface of the substrate by use of a water repellent agent.

However, in recent years, a fine pattern (columnar pattern, linear pattern, etc.) that is very small and that has a high aspect ratio has been formed on a front surface of a substrate in order to realize high integration. Such a fine pattern having a high aspect ratio is liable to fall down. Therefore, a substrate processing method (for example, specification of United States Patent Application Publication No. 2015/279708) in which an IPA liquid film is formed on an upper surface of the substrate, and then the substrate is heated in a state in which a hot plate is in contact with the substrate, has been proposed. A part of the IPA liquid film is evaporated and is changed into a vapor phase thereby, so that the inside of the fine pattern is filled with vapor-phase IPA. Therefore, it is possible to reduce surface tension that acts on the fine pattern.

SUMMARY OF THE INVENTION

Therefore, the organic solvent, such as IPA or a water repellent agent, is removed from the upper surface of the substrate after the upper surface of the substrate is processed by an organic solvent, it is preferable to heat the substrate in a state in which the hot plate is in contact with the substrate.

By the way, when an upper surface of a substrate is processed by an organic solvent, such as IPA or a water repellent agent, the substrate is required to be heated in a state in which a liquid film of the organic solvent is held on the upper surface in order to allow the organic solvent to effectively act on the upper surface of the substrate. There is a possibility that, if the substrate is not rotated when the substrate is heated, the liquid film will be partially evaporated, and the upper surface of the substrate will be partially exposed, which depends on the kind of the organic solvent or on processing contents. If so, surface tension will act on a fine pattern when the liquid film is evaporated in addition to the fact that the upper surface of the substrate cannot be sufficiently treated by the organic solvent. As a result, there is a possibility that the collapse of the fine pattern will occur.

In substrate processing of the specification of United States Patent Application Publication No. 2015/279708, the hot plate must be brought into contact with the substrate in order to sufficiently heat the substrate. There is a fear that the substrate cannot be rotated in that contact state. On the contrary, in order to rotate the substrate, the substrate must be heated by radiant heat emitted from the hot plate in a state in which the hot plate has been separated from the substrate. If so, there is a fear that the substrate cannot be sufficiently heated.

Therefore, an object of the present invention is to provide a substrate processing method and a substrate processing apparatus each of which is capable of excellently processing a substrate by use of an organic solvent and capable of excellently drying the substrate.

The present invention provides a substrate processing method including a substrate holding step of horizontally holding a substrate, a substrate rotating step of rotating the substrate held horizontally around a rotational axis along a vertical direction, a liquid-film forming step of forming a liquid film of a first organic solvent that is used to process an upper surface of the substrate on the upper surface of the substrate by supplying the first organic solvent to the upper surface of the substrate held horizontally, a vapor supplying step of supplying a vapor of a second organic solvent to a space between a facing surface of a heater unit that has the facing surface facing a lower surface of the substrate held horizontally and the lower surface of the substrate, a substrate heating step of heating the substrate that is in a rotational state by means of the vapor of the second organic solvent in parallel with the substrate rotating step and the liquid-film forming step, and a substrate drying step of, after the substrate heating step, excluding the liquid film of the first organic solvent from the substrate held horizontally, and drying the upper surface of the substrate in a state in which the rotation of the substrate is stopped and the substrate is in contact with the heater unit.

According to this method, in the substrate heating step, the substrate is heated by the vapor of the second organic solvent supplied to the space between the facing surface of the heater unit and the lower surface of the substrate. The vapor of the second organic solvent is capable of more efficiently heating the substrate than radiant heat emitted from the heater unit. Therefore, even if the heater unit does not come into contact with the substrate, the substrate can be heated sufficiently. In other words, the substrate being in a rotational state is sufficiently heated. As a result, partial exposure of the upper surface of the substrate, which results from the partial evaporation of the liquid film of the first organic solvent, is restrained. Therefore, the liquid film of the first organic solvent can be formed excellently. Therefore, it is possible to excellently process the upper surface of the substrate by means of the first organic solvent.

On the other hand, in the substrate drying step, the rotation of the substrate is stopped, and the substrate is brought into contact with the heater unit. As a result, the substrate is sufficiently heated. Therefore, the substrate can be dried excellently.

As described above, the substrate can be processed by use of the first organic solvent excellently and can be dried the substrate excellently.

In one preferred embodiment of the present invention, the substrate heating step includes a step of heating the vapor of the second organic solvent that is supplied to the space, by means of the heater unit. According to this method, the vapor of the second organic solvent that is supplied to the space between the facing surface of the heater unit and the lower surface of the substrate, is heated. Therefore, it is possible to efficiently heat the substrate by means of the vapor of the second organic solvent.

In one preferred embodiment of the present invention, the first organic solvent includes a water repellent agent that raises water repellency of the upper surface of the substrate.

According to this method, in the liquid-film forming step, a water repellent agent that raises the water repellency of the upper surface of the substrate is supplied to the upper surface of the substrate. The liquid film of the water repellent agent is comparatively easily divided. Therefore, in order to hold the liquid film on the upper surface of the substrate, the substrate is required to be rotated. Therefore, in the substrate heating step, the substrate being in a rotational state is heated, and therefore the upper surface of the substrate is excellently processed by the water repellent agent.

In one preferred embodiment of the present invention, the second organic solvent includes a volatile organic solvent that is higher in volatility than water.

According to this method, the second organic solvent includes a volatile organic solvent that is higher in volatility than water. Therefore, the second organic solvent is easily maintained in a vapor state. Therefore, the vapor of the second organic solvent supplied to the space between the facing surface of the heater unit and the lower surface of the substrate is restrained from being liquefied. As a result, the second organic solvent is restrained from adhering to the substrate, and therefore it is possible to excellently dry the substrate.

In one preferred embodiment of the present invention, the vapor supplying step includes a second organic solvent supplying step of supplying the second organic solvent that is liquid formed or misty to the space, and a second organic solvent vaporizing step of vaporizing the second organic solvent that is liquid formed or misty by heating the second organic solvent that is liquid formed or misty by means of the heater unit.

According to this method, a second organic solvent that is liquid formed or misty is supplied to the space between the facing surface of the heater unit and the lower surface of the substrate, and hence is heated by the heater unit. The second organic solvent that is liquid formed or misty is vaporized by this heating. Therefore, a vapor for heating the substrate being in a rotational state can be supplied by use of the heater unit to the space between the facing surface of the heater unit and the lower surface of the substrate. The term "liquid formed" denotes a continuous fluid of a liquid. The term "misty" denotes a fluid in which liquid droplets and a gas are mixed together.

In one preferred embodiment of the present invention, the second organic solvent supplying step includes a step of supplying the second organic solvent that is liquid formed or misty toward the facing surface of the heater unit.

According to this method, a liquid formed or misty second organic solvent is supplied toward the facing surface of the heater unit. Therefore, the liquid formed or misty second organic solvent is easily heated by the heater unit. Therefore, the vaporization of the liquid formed or misty second organic solvent is facilitated. Therefore, a vapor for heating the substrate that is in a rotational state, can be supplied to the space between the facing surface of the heater unit and the lower surface of the substrate by efficiently using the heater unit.

In one preferred embodiment of the present invention, the substrate drying step includes a second liquid-film forming step of excluding the liquid film of the first organic solvent from the upper surface of the substrate by supplying a low-surface-tension liquid whose surface tension is lower than water to the upper surface of the substrate and of forming a liquid film of the low-surface-tension liquid on the upper surface of the substrate, and an excluding step of excluding the liquid film of the low-surface-tension liquid from the upper surface of the substrate.

According to this method, in the substrate drying step, the liquid film of the first organic solvent is excluded from the upper surface of the substrate, and the liquid film of the low-surface-tension liquid whose surface tension is lower than water is formed on the upper surface of the substrate. Thereafter, the liquid film of the low-surface-tension liquid is excluded from the upper surface of the substrate. Surface tension that acts on the upper surface of the substrate when the substrate is dried, can thereby be reduced. Therefore, the substrate can be dried excellently.

In one preferred embodiment of the present invention, the excluding step includes an opening forming step of forming an opening in the liquid film of the low-surface-tension liquid by supplying an inert gas to a central area of the liquid film of the low-surface-tension liquid, and an opening enlarging step of excluding the liquid film of the low-surface-tension liquid from the upper surface of the substrate by enlarging the opening.

According to this method, the opening can be formed without leaving liquid droplets in the central area of the liquid film of the low-surface-tension liquid by supplying an inert gas to the central area of the liquid film of the low-surface-tension liquid. By enlarging the opening and by excluding the liquid film of the low-surface-tension liquid from the upper surface of the substrate, the upper surface of the substrate can be dried excellently.

In one preferred embodiment of the present invention, the substrate drying step includes a heater-unit moving step of allowing the heater unit to approach the lower surface of the substrate in order to bring the facing surface into contact with the lower surface of the substrate being in a state in which the rotation has been stopped.

According to this method, it is possible to allow the heater unit to approach the lower surface of the substrate in order to bring the facing surface into contact with the lower surface of the substrate whose rotation has been stopped. Therefore, switching between a state in which the heater unit has been separated from the substrate and a state in which the heater unit is in contact with the substrate, can be performed reliably. Therefore, when the substrate is processed by the first organic solvent, the substrate being in a rotational state can be heated by use of the vapor of the second organic solvent in a state in which the heater unit has been reliably separated from the substrate. Additionally, when the substrate is dried, the substrate can be heated in a state in which the heater unit is reliably in contact with the substrate.

In one preferred embodiment of the present invention, a composition of the first organic solvent is identical with a composition of the second organic solvent. Therefore, even if the vapor of the second organic solvent flows around toward the upper surface side of the substrate when the substrate is heated by the vapor of the second organic solvent, the second organic solvent does not obstruct the processing of the substrate by means of the first organic solvent. Therefore, the upper surface of the substrate can be processed excellently by means of the first organic solvent.

The present invention provides a substrate processing apparatus including a substrate-holding-rotating unit that rotates a substrate held horizontally around a predetermined rotational axis along a vertical direction, a first organic-solvent supplying unit that supplies a first organic solvent that is used to process an upper surface of the substrate to the upper surface of the substrate in order to form a liquid film of the first organic solvent on the upper surface of the substrate, a heater unit that has a facing surface facing a lower surface of the substrate and that is relatively movable to the substrate-holding-rotating unit between a contact position that the heater unit is in contact with the substrate and a separation position that the heater unit is separated from the substrate, and a second organic-solvent supplying unit that supplies a vapor of a second organic solvent to a space between the lower surface of the substrate and the facing surface of the heater unit.

According to this arrangement, a vapor of the second organic solvent is supplied to the space between the facing surface of the heater unit and the lower surface of the substrate in a state in which the heater unit has been separated from the substrate, and the substrate can be heated by means of this vapor. The vapor of the second organic solvent is capable of more efficiently heating the substrate than radiant heat emitted from the heater unit. Therefore, even if the heater unit does not come into contact with the substrate, the substrate can be heated sufficiently. In other words, the substrate being in a rotational state is sufficiently heated. As a result, partial exposure of the upper surface of the substrate, which results from the partial evaporation of the liquid film of the first organic solvent, is restrained. Therefore, the liquid film of the first organic solvent can be formed excellently. Therefore, it is possible to excellently process the upper surface of the substrate by means of the first organic solvent.

On the other hand, when the upper surface of the substrate is dried, the heater unit can be brought into contact with the substrate by stopping the rotation of the substrate and by relatively moving the heater unit with respect to the substrate holding means. As a result, the substrate is sufficiently heated. Therefore, the substrate can be dried excellently.

As described above, the substrate can be processed by use of the first organic solvent excellently and can be dried the substrate excellently.

In one preferred embodiment of the present invention, the substrate processing apparatus further includes a controller that is programmed to perform a substrate rotating step of rotating the substrate by the substrate-holding-rotating unit to rotate the substrate, a liquid-film forming step of forming the liquid film of the first organic solvent on the upper surface of the substrate by supplying the first organic solvent to the upper surface of the substrate from the first organic-solvent supplying unit, a vapor supplying step of supplying the vapor of the second organic solvent to the space from the second organic-solvent supplying unit, a substrate heating step of heating the substrate by means of the vapor of the second organic solvent in parallel with the substrate rotating step and the liquid-film forming step, and a substrate drying step of, after the substrate heating step, excluding the liquid film of the first organic solvent from the substrate, and drying the upper surface of the substrate in a state in which the rotation of the substrate is stopped by the substrate-holding-rotating unit and the substrate is in contact with the heater unit.

According to this arrangement, the vapor supplying step, the substrate heating step, and the substrate drying step are reliably performed by the controller. Therefore, the substrate can be processed excellently by use of the first organic solvent and the substrate can be dried excellently.

In one preferred embodiment of the present invention, the substrate processing apparatus further includes a low-surface-tension liquid supplying unit that supplies a low-surface-tension liquid whose surface tension is lower than water to the upper surface of the substrate. In the substrate processing apparatus, the controller is programmed to perform a liquid-film forming step of excluding the liquid film of the first organic solvent from the upper surface of the substrate and forming a liquid film of the low-surface-tension liquid on the upper surface of the substrate by supplying the low-surface-tension liquid from the low-surface-tension liquid supplying unit, and an excluding step of excluding the liquid film of the low-surface-tension liquid from the upper surface of the substrate.

According to this arrangement, the liquid film of the first organic solvent on the substrate is excluded by supplying a low-surface-tension liquid whose surface tension is lower than water to the upper surface of the substrate from the low-surface-tension liquid supplying unit, and the liquid film of the low-surface-tension liquid is formed on the upper surface of the substrate. Thereafter, the liquid film of the low-surface-tension liquid is excluded from the upper surface of the substrate. Surface tension that acts on the upper surface of the substrate when the substrate is dried, can thereby be reduced. Therefore, the substrate can be dried excellently.

In one preferred embodiment of the present invention, the substrate processing apparatus further includes an inert-gas supplying unit that supplies an inert gas to a central area of the liquid film of the low-surface-tension liquid. In the substrate processing apparatus, the controller is programmed to perform an opening forming step of forming an opening in the central area of the liquid film of the low-surface-tension liquid by supplying an inert gas from the inert-gas supplying unit, and an opening enlarging step of excluding the liquid film of the low-surface-tension liquid from the upper surface of the substrate by enlarging the opening.

According to this arrangement, the opening can be formed without leaving liquid droplets in the central area of the liquid film of the low-surface-tension liquid by supplying an inert gas to the central area of the liquid film of the low-surface-tension liquid from the inert-gas supplying unit.

The upper surface of the substrate can be dried excellently by enlarging the opening and by excluding the liquid film of the low-surface-tension liquid from the upper surface of the substrate.

In one preferred embodiment of the present invention, the first organic-solvent supplying unit includes a water-repellent-agent supplying unit that supplies a water repellent agent that raises water repellency of the upper surface of the substrate to the upper surface of the substrate.

According to this arrangement, a water repellent agent that raises the water repellency of the upper surface of the substrate is supplied to the upper surface of the substrate from the water-repellent-agent supplying unit. The liquid film of the water repellent agent is comparatively easily divided. Therefore, in order to hold the liquid film on the upper surface of the substrate, the substrate is required to be rotated. The substrate can be rotated while heating the substrate by heating the substrate by using the vapor of the second organic solvent in a state in which the heater unit has been separated from the substrate. Therefore, the upper surface of the substrate is excellently processed by the water repellent agent.

In one preferred embodiment of the present invention, the second organic-solvent supplying unit includes a volatile organic solvent supplying unit that supplies a vapor of a volatile organic solvent that is higher in volatility than water and that is the vapor of the second organic solvent to the space.

According to this arrangement, a vapor of a volatile organic solvent that is higher in volatility than water is supplied from the volatile organic solvent supplying unit to the space between the facing surface of the heater unit and the lower surface of the substrate. Therefore, the second organic solvent supplied to the space is easily maintained in a vapor state. Therefore, the vapor of the second organic solvent supplied to the space between the facing surface of the heater unit and the lower surface of the substrate is restrained from being liquefied. As a result, the second organic solvent is restrained from adhering to the substrate, and therefore the substrate can be dried excellently.

In one preferred embodiment of the present invention, the second organic-solvent supplying unit includes a second organic solvent nozzle that supplies the second organic solvent that is liquid formed or misty to the space, and the heater unit that heats the second organic solvent that is liquid formed or misty, that is supplied to the space.

According to this arrangement, the second organic solvent nozzle supplies a second organic solvent that is liquid formed or misty to the space between the facing surface of the heater unit and the lower surface of the substrate. The second organic solvent supplied to this space is heated by the heater unit. The second organic solvent that is liquid formed or misty is vaporized by this heating. Therefore, a vapor for heating the substrate being in a rotational state can be supplied by use of the heater unit to the space between the facing surface of the heater unit and the lower surface of the substrate.

If the second organic solvent nozzle is a straight nozzle, a second organic solvent that is liquid is supplied to the space between the facing surface of the heater unit and the lower surface of the substrate. If the second organic solvent nozzle is a spray nozzle, a second organic solvent that is misty is supplied to the space therebetween.

In one preferred embodiment of the present invention, the second organic solvent nozzle supplies the second organic solvent that is liquid formed or misty toward the facing surface of the heater unit.

According to this arrangement, a second organic solvent is supplied from the second organic solvent nozzle toward the facing surface of the heater unit. Therefore, the second organic solvent is easily heated by the heater unit. Therefore, the vaporization of the second organic solvent that is liquid formed or misty is facilitated. Therefore, a vapor for heating the substrate being in a rotational state can be supplied efficiently to the space between the facing surface of the heater unit and the lower surface of the substrate by using the heater unit.

In one preferred embodiment of the present invention, the facing surface of the heater unit is provided with a concave portion. Therefore, the surface area of the facing surface is made larger than in a case in which the facing surface is flat. Therefore, it is possible to further facilitate the vaporization of the second organic solvent that is liquid formed or misty supplied to the space between the facing surface of the heater unit and the lower surface of the substrate.

In one preferred embodiment of the present invention, the second organic-solvent supplying unit includes a facing-surface nozzle that has a discharge port exposed to the facing surface of the heater unit. According to this arrangement, the discharge port of the facing-surface nozzle is exposed to the facing surface of the heater unit. Therefore, the facing-surface nozzle can supply the second organic solvent to the space between the facing surface and the lower surface of the substrate, reliably.

In one preferred embodiment of the present invention, the second organic-solvent supplying unit includes a lateral nozzle disposed beside the heater unit. According to this arrangement, a nozzle that supplies a second organic solvent can be provided by using a space beside the heater unit.

In one preferred embodiment of the present invention, the substrate processing apparatus further includes a heater-unit raising/lowering mechanism that relatively moves the heater unit with respect to the substrate-holding-rotating unit between the contact position and the separation position.

According to this arrangement, it is possible to allow the heater unit to approach the lower surface of the substrate in order to bring the facing surface into contact with the lower surface of the substrate by relatively moving the heater unit with respect to the substrate holding unit. Therefore, switching between a state in which the heater unit is in contact with the substrate and a state in which the heater unit has been separated from the substrate, can be performed reliably. Therefore, when the substrate is processed by a first organic solvent, the substrate being in a rotational state can be heated by use of the vapor of a second organic solvent in a state in which the heater unit has been reliably separated from the substrate. Additionally, when the substrate is dried, the substrate can be heated in a state in which the heater unit is reliably in contact with the substrate.

In one preferred embodiment of the present invention, a composition of the first organic solvent is identical with a composition of the second organic solvent.

Therefore, even if the vapor of the second organic solvent flows around toward the upper surface side of the substrate when the substrate is heated by the vapor of the second organic solvent, the second organic solvent does not obstruct the processing of the substrate by means of the first organic solvent. Therefore, the upper surface of the substrate can be processed by means of the first organic solvent excellently.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

Figure 1:
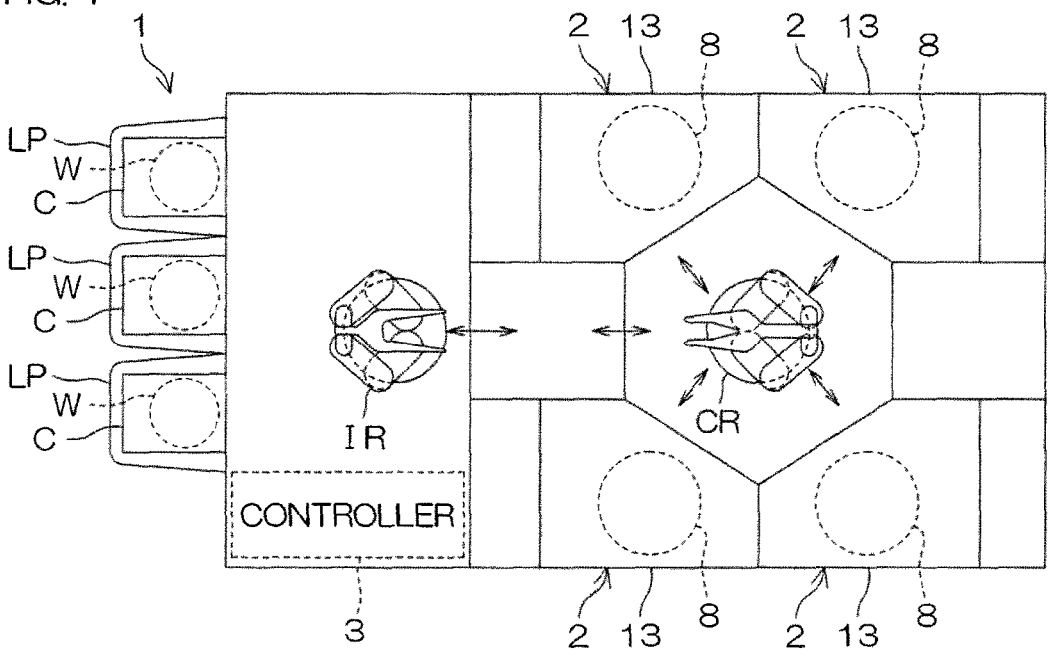
FIG. 1 is an illustrative plan view to describe a layout of the inside of a substrate processing apparatus according to a first preferred embodiment of the present invention.
Figure 9:
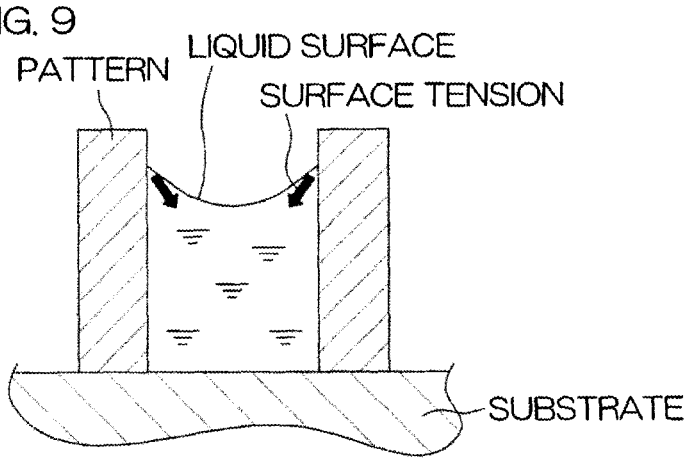
FIG. 9 is an illustrative cross-sectional view to describe the principle of a pattern collapse caused by surface tension.

FIG. 1 is an illustrative plan view to describe a layout of the inside of a substrate processing apparatus 1 according to a first preferred embodiment of the present invention. The substrate processing apparatus 1 is a single substrate processing type apparatus that processes a substrate W, such as a silicon wafer, one by one. In the present preferred embodiment, the substrate W is a circular substrate. A fine pattern (see FIG. 9) is formed on a front surface of the substrate W.

In the present preferred embodiment, the substrate W is a disk-shaped substrate. The substrate processing apparatus 1 includes a plurality of processing units 2 each of which processes a substrate W by use of a processing liquid, a plurality of load ports LP each of which holds a carrier C that houses a plurality of substrates W to be processed by the processing units 2, transfer robots IR and CR that transfer the substrates W between the load ports LP and the processing units 2, and a controller 3 that controls the substrate processing apparatus 1. The transfer robot IR transfers the substrates W between the carriers C and the transfer robot CR. The transfer robot CR transfers the substrates W between the transfer robot IR and the processing units 2. The plurality of processing units 2 have, for example, the same configuration.

Figure 2:
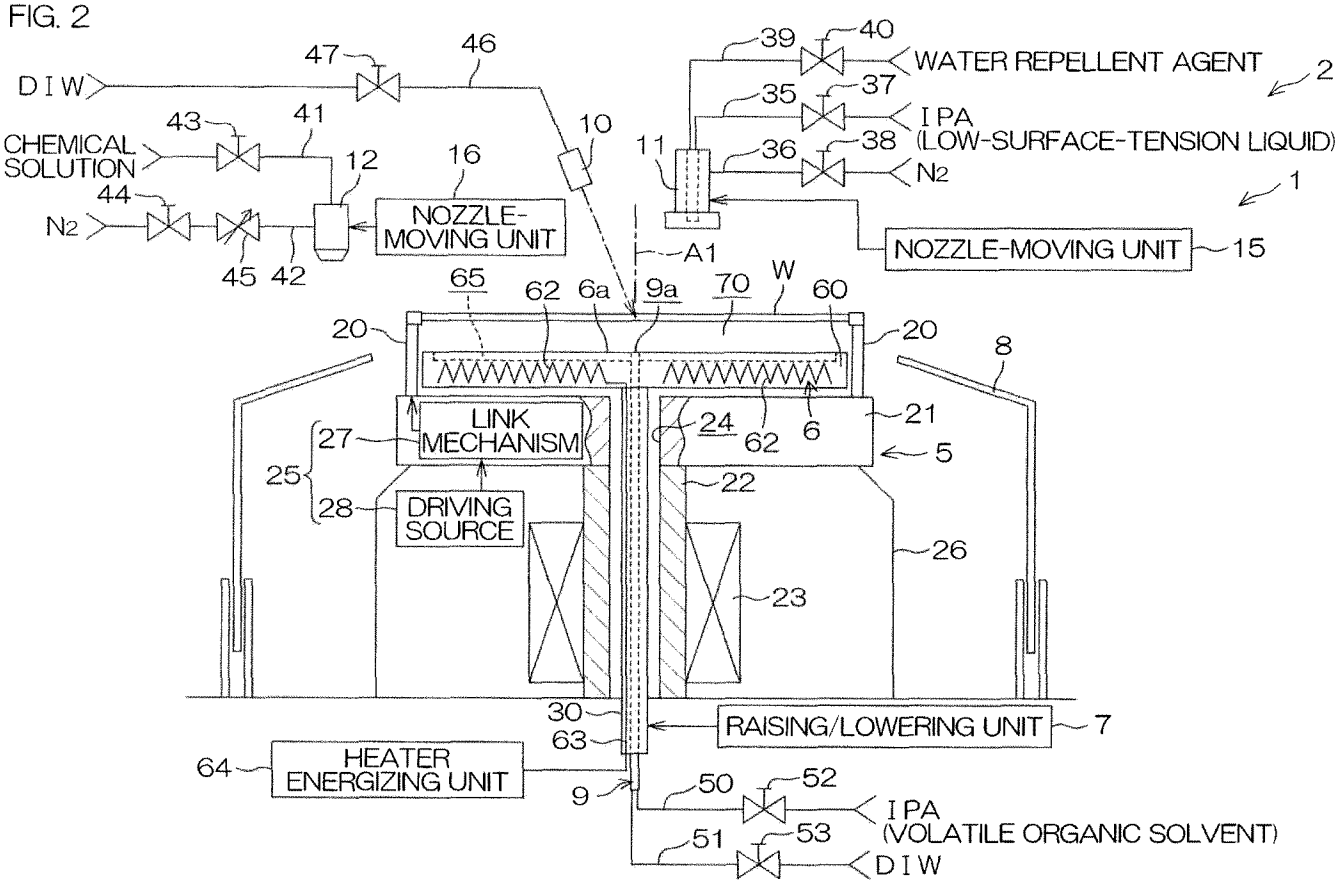
FIG. 2 is an illustrative partial cross-sectional view to describe a configuration example of a processing unit included in the substrate processing apparatus.

FIG. 2 is an illustrative partial cross-sectional view to describe an configuration example of the processing unit 2.

The processing unit 2 includes a spin chuck 5, a heater unit 6, an raising/lowering unit 7, a cylindrical cup 8, a lower surface nozzle 9, a DIW nozzle 10, a first movable nozzle 11, and a second movable nozzle 12. The spin chuck 5 rotates a single substrate W around a vertical rotational axis A1 passing through a center of the substrate W while holding the substrate W in a horizontal attitude. The heater unit 6 has a facing surface 6*a* that faces a lower surface of the substrate W. The raising/lowering unit 7 relatively moves the heater unit 6 upwardly and downwardly with respect to the spin chuck 5. The cup 8 surrounds the spin chuck 5. The lower surface nozzle 9 supplies a fluid to a space 70 between the lower surface of the substrate W and the facing surface 6*a* of the heater unit 6. The DIW nozzle 10 supplies deionized water (DIW) serving as a rinse liquid to an upper surface of the substrate W. The first movable nozzle 11 and the second movable nozzle 12 are movable above the substrate W. The processing unit 2 further includes a chamber 13 (see FIG. 1) that houses the cup 8. A carry-in/carry-out port (not shown) that carries in/out the substrate W is formed in the chamber 13. The chamber 13 is provided with a shutter unit that opens and closes the carry-in/carry-out port.

The spin chuck 5 rotates the horizontally-held substrate W around the predetermined rotational axis A1 extending in a vertical direction. The spin chuck 5 is included in a substrate-holding-rotating unit. The spin chuck 5 includes chuck pins 20, a spin base 21, a rotational shaft 22, and an electric motor 23. The rotational shaft 22 and the electric motor 23 are surrounded by a housing 26 disposed under the spin base 21. The rotational shaft 22 extends in the vertical direction along the rotational axis A1. The rotational shaft 22 is a hollow shaft in the present preferred embodiment. An upper end of the rotational shaft 22 is joined to the center of a lower surface of the spin base 21. The spin base 21 has a disk shape along a horizontal direction. The plurality of chuck pins 20 are disposed at intervals in a circumferential direction at a peripheral edge portion of an upper surface of the spin base 21 (also see FIG. 3 described later). The plurality of chuck pins 20 are openable and closable between a closed state and an open state. In the closed state, the plurality of chuck pins 20 are in contact with a peripheral end of the substrate W, and grasp the substrate W. In the open state, the plurality of chuck pins 20 are in contact with the lower surface of the peripheral edge portion of the substrate W, and are capable of supporting the substrate W from below. In the open state, the plurality of chuck pins 20 retreat from the peripheral end of the substrate W. The spin base 21 and the chuck pin 20 are included in a substrate holding unit that horizontally holds the substrate W.

The electric motor 23 gives a rotational force to the rotational shaft 22. The substrate W is rotated around the rotational axis A1 by being rotated the rotational shaft 22 by the electric motor 23. In the following, an inner side in a rotational radial direction of the substrate W will be referred to simply as the "radially inner side." An outer side in a rotational radial direction of the substrate W will be referred to simply as the "radially outer side." The rotational shaft 22 and the electric motor 23 are included in a substrate rotating unit that rotates the substrate W around the rotational axis A1.

The processing unit 2 further includes a chuck-pin driving unit 25. The chuck-pin driving unit 25 drives the chuck pin 20 so as to open or close the chuck pin 20. The chuck-pin driving unit 25 includes, for example, a link mechanism 27 built into the spin base 21 and a driving source 28 disposed outside the spin base 21. The driving source 28 includes, for example, a ball screw mechanism and an electric motor that gives a driving force thereto.

The heater unit 6 is disposed above the spin base 21. An raising/lowering shaft 30 that extends in the vertical direction along the rotational axis A1 is joined to a lower surface of the heater unit 6. The raising/lowering shaft 30 is inserted into a through-hole 24 formed in a central part of the spin base 21 and into the hollow rotational shaft 22. A lower end of the raising/lowering shaft 30 extends to a more downward position than a lower end of the rotational shaft 22. The raising/lowering unit 7 is joined to the lower end of the raising/lowering shaft 30. The raising/lowering unit 7 is operated, and, as a result, the heater unit 6 is moved upwardly and downwardly between a lower position near the upper surface of the spin base 21 and an upper position at which the heater unit 6 is in contact with the lower surface of the substrate W and then lifts the substrate W from the chuck pin 20. A first separation position and a second separation position are included in positions between the lower position and the upper position. When the heater unit 6 is placed at the first separation position, the facing surface 6*a* of the heater unit 6 separates from the lower surface of the substrate W. When the heater unit 6 is placed at the second separation position, the facing surface 6*a* of the heater unit 6 separates from the lower surface of the substrate W at a position closer to the lower surface of the substrate W than the first separation position.

The position of the heater unit 6 when the facing surface 6*a* of the heater unit 6 is in contact with the lower surface of the substrate W is defined as a contact position. The upper position is included in the contact position. A position that is more upward than the second separation position and at which the facing surface 6*a* is in contact with the lower surface of the substrate W is also included in the contact position.

When the heater unit 6 is placed at the first separation position or the second separation position, a space 70 is formed between the facing surface 6*a* of the heater unit 6 and the lower surface of the substrate W. When the heater unit 6 is not in contact with the substrate W, The heater unit 6 can heat the substrate by means of radiant heat emitted from the facing surface 6*a*. When the heater unit 6 is placed at the contact position, the heater unit 6 can heat the substrate W with a large amount of heat because of heat conduction from the facing surface 6*a*.

The raising/lowering unit 7 includes, for example, a ball screw mechanism and an electric motor that gives a driving force thereto. The raising/lowering unit 7 can dispose the heater unit 6 at an arbitrary intermediate position between the lower position and the upper position. Therefore, the raising/lowering unit 7 functions as a heater-unit raising/lowering mechanism that can move (raise and lower) the heater unit 6 relatively with respect to the spin base 21 between the contact position and the first separation position.

The first movable nozzle 11 is moved in the horizontal direction and in the vertical direction by means of a first nozzle-moving unit 15. The first movable nozzle 11 is movable between a center position and a home position (retreat position) by being moved in the horizontal direction. When the first movable nozzle 11 is placed at the center position, the first movable nozzle 11 faces a rotational center of the upper surface of the substrate W. When the first movable nozzle 11 is placed at the home position, the first movable nozzle 11 does not face the upper surface of the substrate W. The rotational center of the upper surface of the substrate W is a position that crosses the rotational axis A1 in the upper surface of the substrate W. When the first movable nozzle 11 is placed at the home position, the first movable nozzle 11 is placed outside the spin base 21 in a plan view. More specifically, when the first movable nozzle 11 is placed at the home position, the first movable nozzle 11 may be placed outside the cup 8. The first movable nozzle 11 is capable of approaching the upper surface of the substrate W and is capable of retreating upwardly from the upper surface of the substrate W by being moved in the vertical direction. The first nozzle-moving unit 15 includes, for example, a rotational shaft along the vertical direction, an arm that is joined to the rotational shaft and extends horizontally, and an arm driving mechanism that drives the arm. The arm driving mechanism swings the arm by rotating the rotational shaft around a vertical rotational axis. The arm driving mechanism moves the arm upwardly and downwardly by raising and lowering the rotational shaft in the vertical direction. The first movable nozzle 11 is fixed to the arm. The first movable nozzle 11 moves in the horizontal direction and in the vertical direction in accordance with the swing and the raising/lowering movement of the arm.

The second movable nozzle 12 is moved in the horizontal direction and in the vertical direction by means of a second nozzle-moving unit 16. The second movable nozzle 12 is capable of being moved between the center position and the home position (retreat position) by being moved in the horizontal direction. When the second movable nozzle 12 is placed at the center position, the second movable nozzle 12 faces the rotational center of the upper surface of the substrate W. When the second movable nozzle 12 is placed at the home position, the second movable nozzle 12 does not face the upper surface of the substrate W. When the second movable nozzle 12 is placed at the home position, the second movable nozzle 12 is placed outside the spin base 21 in a plan view. More specifically, when the second movable nozzle 12 is placed at the home position, the second movable nozzle 12 may be placed outside the cup 8. The second movable nozzle 12 is capable of approaching the upper surface of the substrate W or is capable of retreating upwardly from the upper surface of the substrate W by being moved in the vertical direction. The second nozzle-moving unit 16 includes, for example, a rotational shaft along the vertical direction, an arm that is joined to the rotational shaft and that extends horizontally, and an arm driving mechanism that drives the arm. The arm driving mechanism swings the arm by rotating the rotational shaft around a vertical rotational axis. The arm driving mechanism moves the arm upwardly and downwardly by raising and lowering the rotational shaft in the vertical direction. The second movable nozzle 12 is fixed to the arm. The second movable nozzle 12 moves in the horizontal direction and in the vertical direction in accordance with the swing and the raising/lowering movement of the arm.

In the present preferred embodiment, the first movable nozzle 11 has a function as a water-repellent-agent supplying unit that supplies a water repellent agent to the upper surface of the substrate W, a function as a low-surface-tension liquid supplying unit that supplies a low-surface-tension liquid to the upper surface of the substrate W, and a function as an inert-gas supplying unit that supplies an inert gas, such as nitrogen gas, to the upper surface of the substrate W. The water repellent agent is capable of heightening the water repellency of the upper surface of the substrate W. The surface tension of the low-surface-tension liquid is lower than the surface tension of water. In the present preferred embodiment, an example in which isopropyl alcohol (IPA) is used as the low-surface-tension liquid is shown.

A water-repellent-agent supply pipe 39, a low-surface-tension liquid supply pipe 35, and an inert-gas supply pipe 36 are joined to the first movable nozzle 11. A water-repellent-agent valve 40 that opens and closes a flow passage inside the water-repellent-agent supply pipe 39 is interposed in the water-repellent-agent supply pipe 39. A water repellent agent is supplied from a water-repellent-agent supply source to the water-repellent-agent supply pipe 39. A low-surface-tension liquid valve 37 that opens and closes a flow passage inside the low-surface-tension liquid supply pipe 35 is interposed in the low-surface-tension liquid supply pipe 35. A low-surface-tension liquid, such as IPA, is supplied from a low-surface-tension liquid supply source to the low-surface-tension liquid supply pipe 35. An inert-gas valve 38 that opens and closes a flow passage inside the inert-gas supply pipe 36 is interposed in the inert-gas supply pipe 36. An inert gas, such as nitrogen gas, is supplied from an inert-gas supply source to the inert-gas supply pipe 36.

For example, a silicon-based water repellent agent that hydrophobizes silicon itself or a compound including silicon or a metal-based water repellent agent that hydrophobizes metal itself or a compound including metal is usable as the water repellent agent. The metal-based water repellent agent includes, for example, at least one of amine that has a hydrophobic group and an organic silicon compound. The silicon-based water repellent agent is, for example, a silane coupling agent. The silane coupling agent includes, for example, at least one among HMDS (hexamethyldisilazane), TMS (tetramethylsilane), fluoridated alkylchlorosilane, alkyldisilazane, and a non-chloro-based water repellent agent. The non-chloro-based water repellent agent includes, for example, at least one among dimethylsilyldimethylamine, dimethylsilyldiethylamine, hexamethyldisilazane, tetramethyldisilazane, bis(dimethylamino)dimethylsilane, N,N-dimethylaminotrimethylsilane, N-(trimethylsilyl)dimethylamine, and an organosilane compound.

An organic solvent, which does not make a chemical reaction (i.e., which is low in reactivity) to the upper surface of the substrate W and to a pattern (see FIG. 9) formed on the substrate W, is used as the low-surface-tension liquid supplied by the first movable nozzle 11. More specifically, a liquid that includes at least one among IPA, HFE (hydrofluoroether), methanol, ethanol, acetone, and trans-1,2-dichloroethylene may be used as the low-surface-tension liquid. Additionally, the low-surface-tension liquid is not required to consist of only monocomponent. In other words, the low-surface-tension liquid may be a liquid mixed with other components. For example, the low-surface-tension liquid may be a mixture of an IPA liquid and pure water. The low-surface-tension liquid may be a mixture of an IPA liquid and an HFE liquid.

The water repellent agent supplied by the first movable nozzle 11 is an example of a first organic solvent to process the upper surface of the substrate W. In other words, the first movable nozzle 11 is included in a first organic-solvent supplying unit that supplies the first organic solvent to the upper surface of the substrate W.

An inert gas supplied from the inert-gas supply pipe 36 is not limited to nitrogen gas. The inert gas is a gas that is inert with respect to the upper surface of the substrate W and with respect to a pattern. The inert gas supplied from the inert-gas supply pipe 36 may be rare gases, such as argon.

In the present preferred embodiment, the second movable nozzle 12 has a function as a chemical-solution supplying unit that supplies a chemical solution, such as an acid chemical solution or an alkaline chemical solution, to the upper surface of the substrate W and a function as an inert-gas supplying unit that supplies an inert gas, such as nitrogen gas, to the upper surface of the substrate W. More specifically, the second movable nozzle 12 may have a two-fluid nozzle form that is capable of discharging a liquid and a gas that have been mixed together in the nozzle. The two-fluid nozzle is usable as a liquid nozzle if the supply of a gas is stopped and if a liquid is discharged, whereas the two-fluid nozzle is usable as a gas nozzle if the supply of a liquid is stopped and if a gas is discharged.

A chemical-solution supply pipe 41 and an inert-gas supply pipe 42 are joined to the second movable nozzle 12. A chemical solution valve 43 that opens and closes a flow passage inside the chemical-solution supply pipe 41 is interposed in the chemical-solution supply pipe 41. An inert-gas valve 44 that opens and closes a flow passage inside the inert-gas supply pipe 42 and a flow-rate variable valve 45 that is capable of varying the flow rate of an inert gas are interposed in the inert-gas supply pipe 42. A chemical solution, such as an acid chemical solution or an alkaline chemical solution, is supplied from a chemical-solution supply source to the chemical-solution supply pipe 41. An inert gas, such as nitrogen gas ($N_2$), is supplied from the inert-gas supply source to the inert-gas supply pipe 42.

Concrete examples of the chemical solution are an etching liquid and a cleaning liquid. More specifically, the chemical solution may be hydrofluoric acid, SC1 (ammonia oxygenated water mixture), SC2 (hydrochloric-acid oxygenated water mixture), or buffered hydrofluoric acid (mixture consisting of hydrofluoric acid and ammonium fluoride), etc.

In the present preferred embodiment, the DIW nozzle 10 is a stationary nozzle disposed to discharge DIW toward the rotational center of the upper surface of the substrate W. DIW is supplied from a DIW supply source to the DIW nozzle 10 through a DIW supply pipe 46. A DIW valve 47 that opens and closes a flow passage inside the DIW supply pipe 46 is interposed in the DIW supply pipe 46. The DIW nozzle 10 is not necessarily required to be a stationary nozzle. The DIW nozzle 10 may be a movable nozzle that moves at least in the horizontal direction.

The DIW nozzle 10 may be a rinse-liquid nozzle that supplies a rinse liquid other than DIW. The rinse liquid is not limited to DIW. The rinse liquid may be soda water, electrolyzed ion water, ozone water, hydrochloric acid water having a diluted concentration (for example, about 10 to 100 ppm), or restoration water (hydrogenated water), etc.

In the present preferred embodiment, the lower surface nozzle 9 has a function as a volatile-organic-solvent nozzle that supplies a liquid volatile organic solvent, such as IPA, which is high in volatility than water, to the space 70 between the facing surface 6*a* of the heater unit 6 and the lower surface of the substrate W, and a function as a rinse-liquid nozzle that supplies a rinse liquid, such as DIW, to the lower surface of the substrate W. The lower surface nozzle 9 supplies a liquid formed volatile organic solvent toward the facing surface 6*a* of the heater unit 6. The lower surface nozzle 9 has a straight nozzle form that is capable of supplying a liquid formed volatile organic solvent.

The lower surface nozzle 9 may be arranged to supply a misty volatile organic solvent to the space 70 unlike the present preferred embodiment. Additionally, the lower surface nozzle 9 may be arranged to supply a misty volatile organic solvent toward the facing surface 6*a*. In this case, the lower surface nozzle 9 may have a spray nozzle form that is capable of supplying a misty volatile organic solvent.

The lower surface nozzle 9 is inserted into the hollow raising/lowering shaft 30, and further passes through the heater unit 6. The lower surface nozzle 9 has a facing-surface nozzle form having a discharge port 9*a* exposed from the facing surface 6*a* of the heater unit 6*a* at an upper end of the lower surface nozzle. The discharge port 9*a* is placed at a position overlapping the rotational axis A1 in a plan view.

A volatile-organic-solvent supply pipe 50 and a DIW supply pipe 51 are joined to the lower surface nozzle 9. A volatile-organic-solvent valve 52 that opens and closes a flow passage inside the volatile-organic-solvent supply pipe 50 is interposed in the volatile-organic-solvent supply pipe 50. A DIW valve 53 that opens and closes a flow passage inside the DIW supply pipe 51 is interposed in the DIW supply pipe 51.

An organic solvent exclusive of IPA, which does not make a chemical reaction (i.e., which is low in reactivity) to the upper surface of the substrate W and to a pattern (see FIG. 9) formed on the substrate W, is used as the volatile organic solvent. More specifically, a liquid that includes at least one among IPA, HFE (hydrofluoroether), methanol, ethanol, acetone, and trans-1,2-dichloroethylene may be used as the volatile organic solvent. Additionally, the volatile organic solvent is not required to consist of only monocomponent. In other words, the volatile organic solvent may be a liquid mixed with other components. For example, the volatile organic solvent may be a mixture of an IPA liquid and an HFE liquid. Preferably, the volatile organic solvent has a water content restrained as low as possible. The aforementioned water repellent agent may be used as the volatile organic solvent.

The volatile organic solvent supplied by the lower surface nozzle 9 is an example of a second organic solvent. In other words, the lower surface nozzle 9 is included in a second organic solvent nozzle that supplies a second organic solvent that is liquid to the space 70 between the lower surface of the substrate W and the facing surface 6*a* of the heater unit 6.

Figure 3:
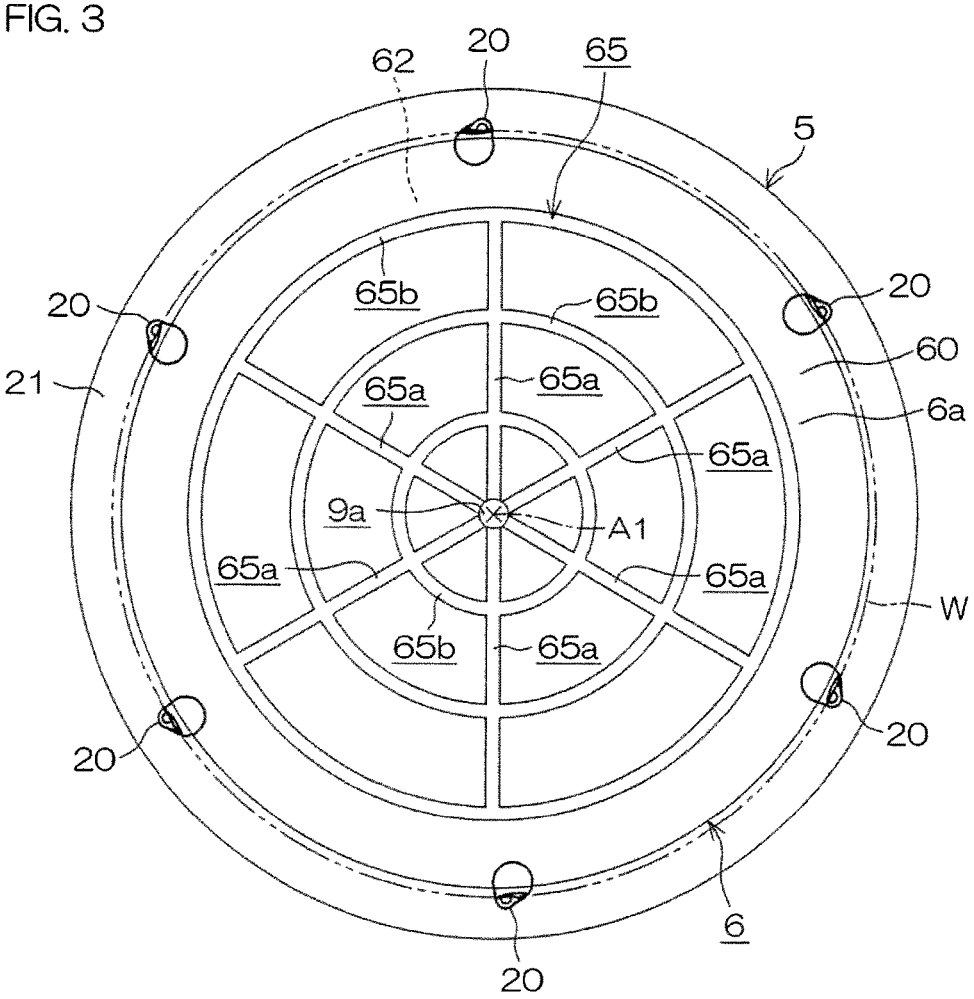
FIG. 3 is a schematic plan view of a spin base and a heater unit of the processing unit.

FIG. 3 is a schematic plan view of the spin base 21 and the heater unit 6. The spin base 21 of the spin chuck 5 has a circular shape that centers on the rotational axis A1 in a plan view. The diameter of the spin base 21 is larger than the diameter of the substrate W. A plurality of (in the present preferred embodiment, six) chuck pins 20 are disposed at a peripheral edge portion of the spin base 21 with a space therebetween.

The heater unit 6 has a disk-shaped hot plate form. The heater unit 6 includes a plate body 60 and a heater 62 (see FIG. 2 also). The plate body 60 is substantially the same in shape and in size as the external shape of the substrate W in a plan view, and is formed in a circular shape that centers on the rotational axis A1. More accurately, the plate body 60 has a circular planar shape whose diameter is slightly smaller than the diameter of the substrate W. For example, the diameter of the substrate W is 300 mm, and the diameter of the plate body 60 (particularly the diameter of the facing surface 6*a*) may be 294 mm that is smaller by 6 mm than that of the substrate W. In this case, the radius of the plate body 60 is smaller by 3 mm than the radius of the substrate W.

The facing surface 6*a* that is also an upper surface of the plate body 60 is a flat surface along a horizontal plane. The facing surface 6*a* is provided with a concave portion 65. The concave portion 65 includes a radial concave portion 65*a* that radially extends outwardly in the radial direction from the discharge port 9*a* of the lower surface nozzle 9 and a circumferential concave portion 65*b* that extends in the circumferential direction around the discharge port 9*a* of the lower surface nozzle 9 (i.e., around the rotational axis A1).

In the present preferred embodiment, the radial concave portion 65*a* extends linearly, and the circumferential concave portion 65*b* is circular in a plan view. A plurality of radial concave portions 65*a* may be provided. The plurality of radial concave portions 65*a* are disposed at intervals in the circumferential direction around the rotational axis A1. A plurality of circumferential concave portions 65*b* may be provided. The plurality of circumferential concave portions 65*b* are disposed at in the rotational radial direction. The radial concave portion 65*a* and the circumferential concave portion 65*b* intersect with each other, and communicate with each other. Each radial concave portion 65*a* may communicate with all of the circumferential concave portions 65*b*, or each circumferential concave portion 65*b* may communicate with all of the radial concave portions 65*a*. Unlike the present preferred embodiment, a form in which only one radial concave portion 65*a* is disposed is possible, and a form in which only one circumferential concave portion 65*b* is disposed is possible. The facing surface 6*a* may include a plurality of projections (not shown) that support the substrate W from below.

The heater 62 may be a resistive element built into the plate body 60. The facing surface 6*a* is heated to become higher in temperature than room temperature (e.g., 20 to 30° C. e.g., 25° C.) by energizing the heater 62. In detail, energization of the heater 62 makes it possible to heat the facing surface 6*a* so as to become higher in temperature than the boiling point of an organic solvent supplied from the first movable nozzle 11. The temperature of the facing surface 6*a* of the heater unit 6 is, for example, about 150° C., and the facing surface 6*a* is uniform in the plane. Heating by radiant heat makes it possible to warm the substrate W to about 30° C. As shown in FIG. 2, an electric supply line 63 to the heater 62 is passed through the inside of the raising/lowering shaft 30. A heater energizing unit 64 that supplies electric power to the heater 62 is connected to the electric supply line 63. The heater energizing unit 64 may be always energized during the operation of the substrate processing apparatus 1.

Figure 4:
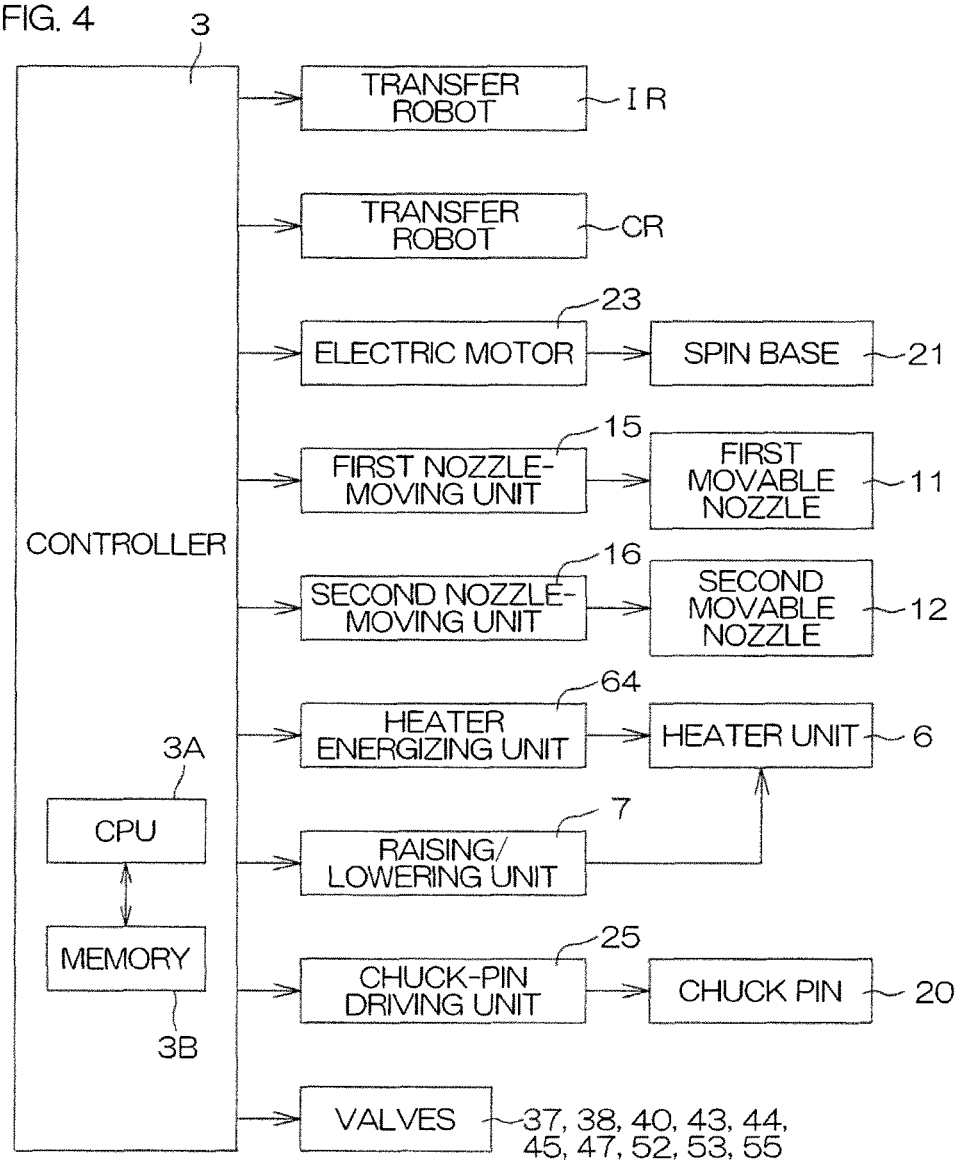
FIG. 4 is a block diagram to describe an electric configuration of a main part of the substrate processing apparatus.

FIG. 4 is a block diagram to describe an electric configuration of a main part of the substrate processing apparatus 1. The controller 3 includes a microcomputer, and controls control objects included in the substrate processing apparatus 1 in accordance with a predetermined control program. More specifically, the controller 3 includes a processor (CPU) 3A and a memory 3B in which a control program is stored, and is configured to perform various controls for substrate processing by executing the control program by the processor 3A. Particularly, the controller 3 controls operations of the electric motor 23 that rotationally drives the transfer robots IR, CR and the spin chuck 5, the first nozzle-moving unit 15, the second nozzle-moving unit 16, the heater energizing unit 64, the raising/lowering unit 7 that moves the heater unit 6 raising/lowering, the chuck-pin driving unit 25, the valves 37, 38, 40, 43, 44, 45, 47, 52, 53, etc.

Figure 5:
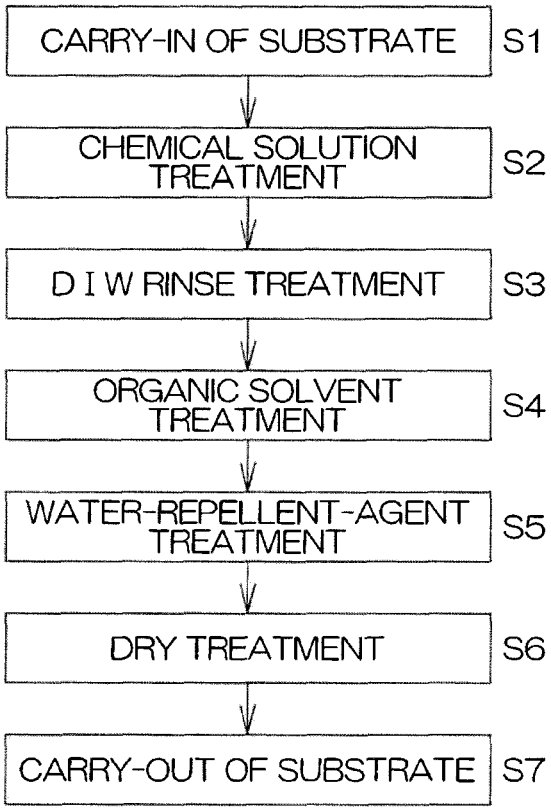
FIG. 5 is a flowchart to describe an example of substrate processing performed by the substrate processing apparatus.

FIG. 5 is a flowchart to describe an example of substrate processing performed by the substrate processing apparatus 1. An unprocessed substrate W is carried from the carrier C into the processing unit 2 by means of the transfer robots IR and CR, and is delivered to the spin chuck 5 (S1). Thereafter, the substrate W is horizontally held by the spin chuck 5 until the substrate W is carried out by the transfer robot CR (substrate holding step). The controller 3 then controls the raising/lowering unit 7 so as to place the heater unit 6 at the lower position.

Next, chemical solution treatment (S2) will be described. After the transfer robot CR retreats outwardly from the processing unit 2, chemical solution treatment (S2) is started.

The controller 3 drives the electric motor 23, and rotates the spin base 21. As a result, the substrate W horizontally held rotates (substrate rotating step). On the other hand, the controller 3 controls the second nozzle-moving unit 16 so as to place the second movable nozzle 12 at a chemical-solution treatment position above the substrate W. When the second movable nozzle 12 is placed at the chemical-solution treatment position, a chemical solution discharged from the second movable nozzle 12 lands at the rotational center of the upper surface of the substrate W. The controller 3 then opens the chemical solution valve 43. As a result, a chemical solution is supplied from the second movable nozzle 12 toward the upper surface of the substrate W being in a rotational state. The chemical solution supplied thereto spreads across the entirety of the upper surface of the substrate W by means of a centrifugal force.

The controller 3 opens the DIW valve 53 during the chemical solution treatment. As a result, DIW is supplied from the lower surface nozzle 9 toward the lower surface of the substrate W being in a rotational state. The DIW supplied thereto spreads across the entirety of the lower surface of the substrate W by means of a centrifugal force. As a result, the lower surface of the substrate W is washed. Therefore, it is possible to restrain the chemical solution supplied to the upper surface of the substrate W by means of the chemical solution treatment from flowing around toward the lower surface of the substrate W. Even if the chemical solution adheres to the lower surface of the substrate W, the chemical solution that has adhered to the lower surface of the substrate W is rinsed away by means of DIW supplied from the lower surface nozzle 9.

Next, DIW rinse treatment (S3) will be described. After the chemical solution treatment is performed for a fixed time, DIW rinse treatment (S3) is performed. In the DIW rinse treatment (S3), a chemical solution is excluded from the surface of the substrate W by replacing the chemical solution on the substrate W with DIW.

In detail, the controller 3 closes the chemical solution valve 43, and opens the DIW valve 47 instead. As a result, DIW is supplied from the DIW nozzle 10 toward the upper surface of the substrate W being in a rotational state. The DIW supplied thereto spreads across the entirety of the upper surface of the substrate W by means of a centrifugal force. The chemical solution on the substrate W is rinsed away by means of the DIW. During this time, the controller 3 controls the second nozzle-moving unit 16 to retract the second movable nozzle 12 from above the substrate W to a side of the cup 8. Before completing the DIW rinse treatment, the controller 3 closes the DIW valve 53 to stop the supply of DIW to the lower surface of the substrate W from the lower surface nozzle 9.

Next, organic solvent treatment (S4) will be described. After performing the DIW rinse treatment for a fixed time, organic solvent treatment (S4) is performed. In the organic solvent treatment (S4), the DIW on the substrate W is replaced with an organic solvent (for example, IPA) that has a greater affinity for a water repellent agent than DIW.

The controller 3 controls the first nozzle-moving unit 15 to move the first movable nozzle 11 to an organic-solvent rinse position above the substrate W. When the first movable nozzle 11 is placed at the organic-solvent rinse position, an organic solvent (for example, IPA) discharged from the first movable nozzle 11 lands at the rotational center of the upper surface of the substrate W. The controller 3 then closes the DIW valve 47, and opens the low-surface-tension liquid valve 37. As a result, an organic solvent (low-surface-tension liquid), such as IPA, is supplied from the first movable nozzle 11 toward the upper surface of the substrate W being in a rotational state. The organic solvent supplied thereto spreads across the entirety of the upper surface of the substrate W by means of a centrifugal force, and the DIW on the substrate W is replaced therewith.

Next, water-repellent-agent treatment (S5) will be described. After performing the organic solvent treatment for a fixed time, water-repellent-agent treatment (S5) is performed. In the water-repellent-agent treatment (S5), the water repellency of the upper surface of the substrate W is heightened by replacing an organic solvent, such as IPA, on the substrate W with a water repellent agent.

The controller 3 controls the first nozzle-moving unit 15 to move the first movable nozzle 11 to a water-repellent-agent treatment position above the substrate W. When the first movable nozzle 11 is placed at the water-repellent-agent treatment position, a water repellent agent discharged from the first movable nozzle 11 lands at the rotational center of the upper surface of the substrate W. The water-repellent-agent treatment position may be the same position as the organic-solvent rinse position. The controller 3 closes the low-surface-tension liquid valve 37, and opens the water-repellent-agent valve 40. As a result, a water repellent agent is supplied from the first movable nozzle 11 toward the upper surface of the substrate W being in a rotational state (water-repellent-agent supplying step). The water repellent agent supplied thereto spreads across the entirety of the upper surface of the substrate W by means of a centrifugal force, and the IPA on the substrate W is replaced therewith. As a result, the water repellent agent forms a thin film on the upper surface of the substrate W, and the water repellency of the upper surface of the substrate W is heightened.

Next, dry treatment (S6) will be described. After performing the water-repellent-agent treatment for a fixed time, dry treatment (S6) is performed. In the dry treatment (S6), a liquid film of a low-surface-tension liquid is formed by replacing the water repellent agent on the upper surface of the substrate W with a low-surface-tension liquid, such as IPA. Thereafter, the upper surface of the substrate W is dried by excluding the liquid film of the low-surface-tension liquid from the upper surface of the substrate W.

The controller 3 controls the raising/lowering unit 7 to raise the heater unit 6 toward the substrate W, and the substrate W is heated thereby. Furthermore, the controller 3 decelerates the rotation of the spin chuck 5 and stops the rotation of the substrate W, and closes the low-surface-tension liquid valve 37 so as to stop the supply of a low-surface-tension liquid. As a result, a puddle state is reached in which the liquid film of the low-surface-tension liquid is supported on the substrate W being in a stationary state. Furthermore, part of the low-surface-tension liquid contiguous to the upper surface of the substrate W is evaporated by heating the substrate W in a state in which the substrate W is in contact with the heater unit 6. As a result, a vapor phase layer is formed between the liquid film of the low-surface-tension liquid and the upper surface of the substrate W. The liquid film of the low-surface-tension liquid being supported by the vapor phase layer is excluded.

To exclude the liquid film of the low-surface-tension liquid, the controller 3 controls the first nozzle-moving unit 15 to retract the first movable nozzle 11 from above the substrate W to a side of the cup 8. Furthermore, the controller 3 controls the second nozzle-moving unit 16 to position the second movable nozzle 12 at a gas discharge position above the substrate W. When the second movable nozzle 12 is placed at the gas discharge position, an inert gas flow discharged from the second movable nozzle 12 is directed to the rotational center of the upper surface of the substrate W. Thereafter, the controller 3 opens the inert-gas valve 44. As a result, an inert gas is discharged toward the liquid film of the low-surface-tension liquid on the substrate W. As a result, the low-surface-tension liquid is excluded by the inert gas at a position at which the discharge of an inert gas is received, i.e., at the center of the substrate W. An opening that exposes the upper surface of the substrate W is formed at the center of the liquid film of the low-surface-tension liquid by excluding the low-surface-tension liquid at the center of the substrate W. The low-surface-tension liquid on the substrate W is discharged outwardly from the substrate W by enlarging the opening. The upper surface of the substrate W is dried by discharging the IPA from the surface of the substrate W toward the outside of the substrate W. As described above, the upper surface of the substrate W is dried in a state in which the rotation of the substrate W has been stopped and in which the heater unit 6 has been in contact with the substrate W (substrate drying step).

Thereafter, the controller 3 closes the inert-gas valve 44. The controller 3 retracts the second movable nozzle 12, and then controls the electric motor 23 so that the substrate W rotates at high-speed. As a result, spin drying is performed. In the spin drying, the upper surface of the substrate W is further dried by shaking off liquid components lying on the substrate W by means of a centrifugal force.

Next, substrate carrying-out (S7) will be described.

Thereafter, the controller 3 controls the electric motor 23 to stop the rotation of the spin chuck 5. Furthermore, the controller 3 controls the raising/lowering unit 7 so that the heater unit 6 is placed at the lower position. Furthermore, the controller 3 controls the chuck-pin driving unit 25 so that the chuck pin 20 is placed at the open position. Thereafter, the transfer robot CR enters the processing unit 2, and scoops an already-processed substrate W from the spin chuck 5, and carries it out of the processing unit 2 (S7). The substrate W is delivered from the transfer robot CR to the transfer robot IR, and is stored in the carrier C by means of the transfer robot IR.

Figure 6:
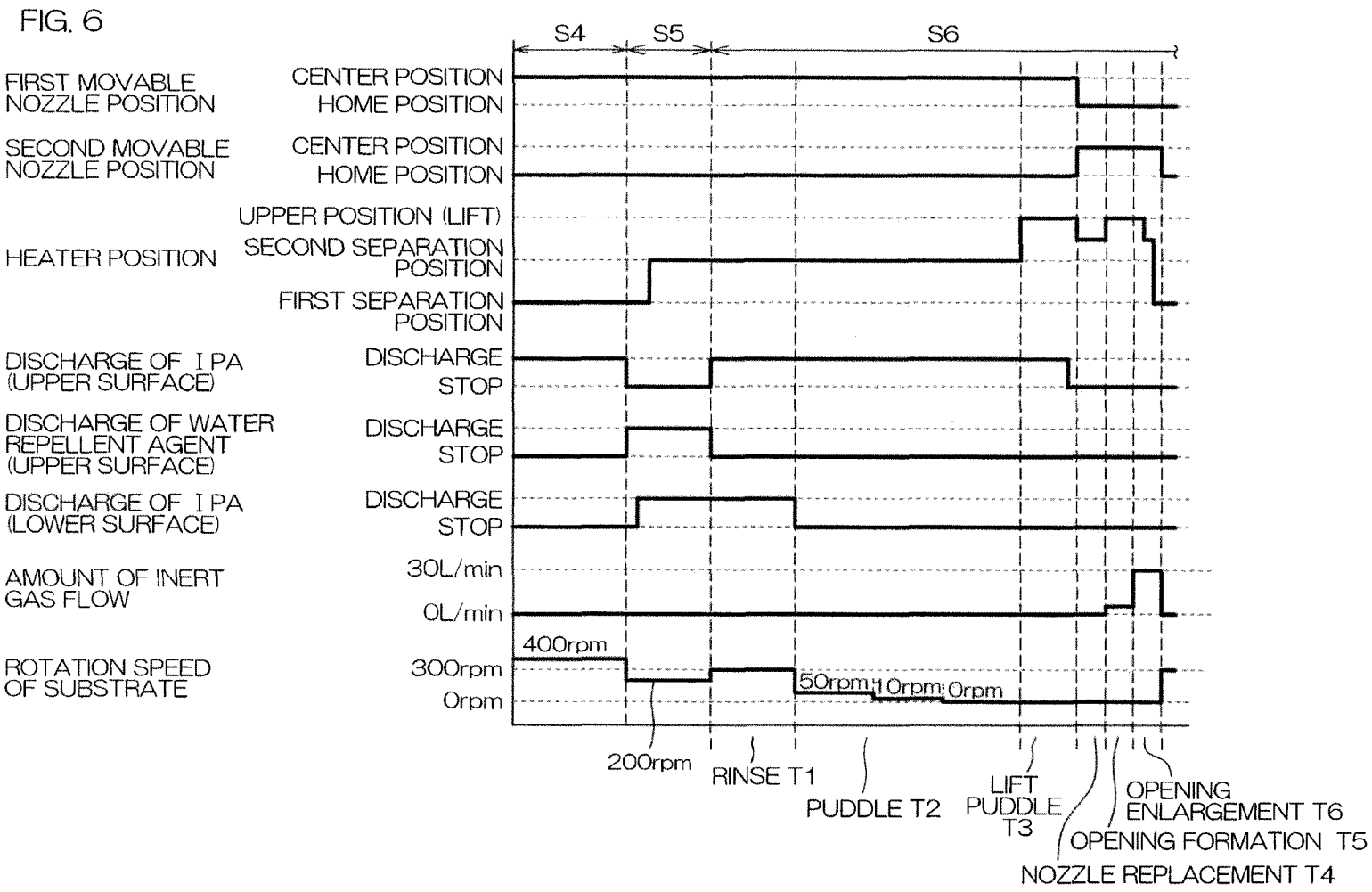
FIG. 6 is a time chart to describe the details of substrate processing.
Figure 7A:
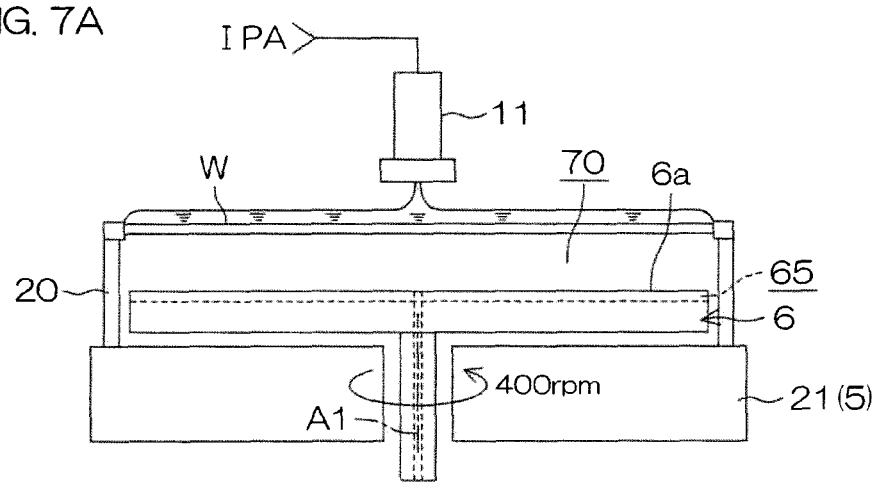
FIG. 7A is an illustrative cross-sectional view to describe organic solvent treatment (S4 of FIG. 5).
Figure 7B:
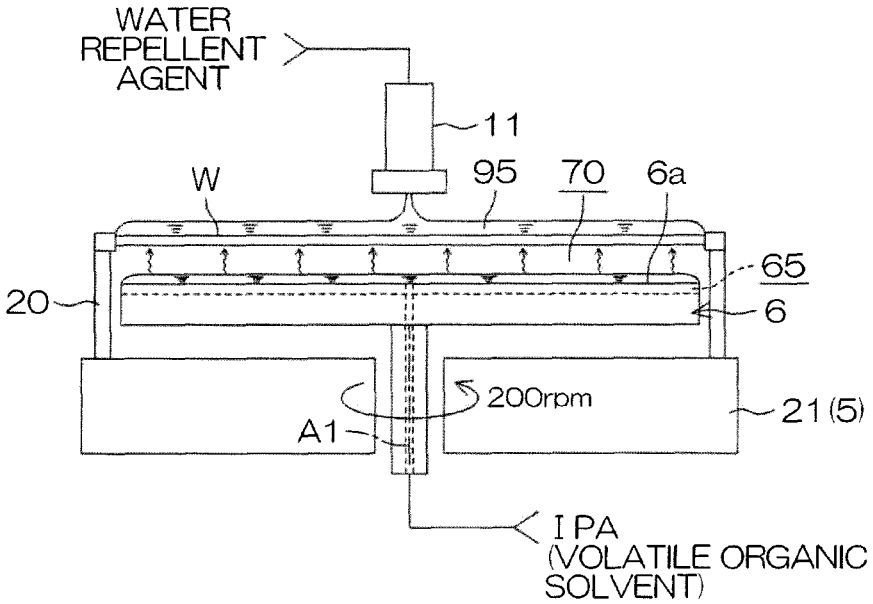
FIG. 7B is an illustrative cross-sectional view to describe water-repellent-agent treatment (S5 of FIG. 5).
Figure 7C:
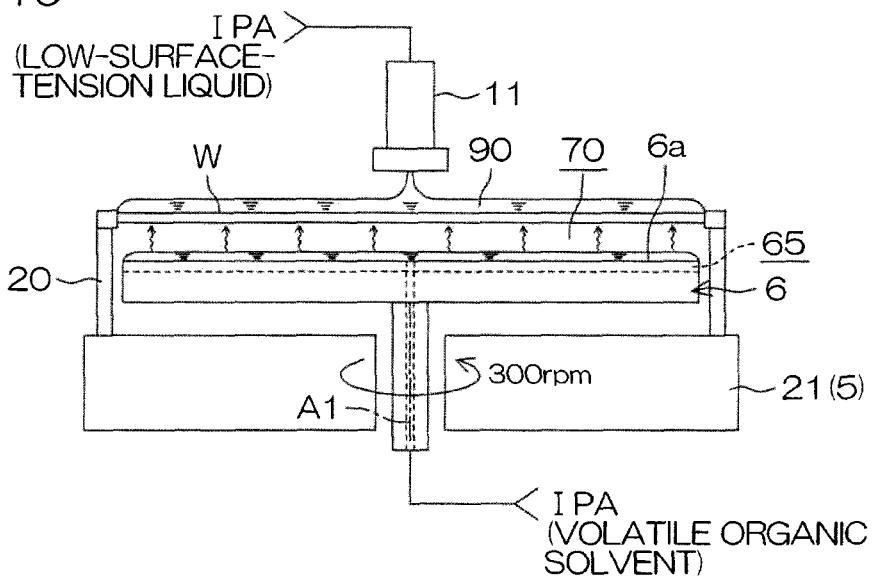
FIG. 7C to FIG. 7H are illustrative cross-sectional views to describe dry treatment (S6 of FIG. 5).

FIG. 6 is a time chart to describe the details of the organic solvent treatment of substrate processing (S4 of FIG. 5), the water-repellent-agent treatment (S5 of FIG. 5), and the dry treatment (S6 of FIG. 5). FIG. 7A is an illustrative cross-sectional view to describe the organic solvent treatment. FIG. 7B is an illustrative cross-sectional view to describe the water-repellent-agent treatment. FIG. 7C to FIG. 7H are illustrative cross-sectional views to describe the dry treatment.

With reference to FIG. 6 and FIG. 7A, in the organic solvent treatment, the controller 3 controls the first nozzle-moving unit 15 to position the first movable nozzle 11 at the center position. The controller 3 opens the low-surface-tension liquid valve 37 to replace the DIW on the upper surface of the substrate W with an organic solvent (low-surface-tension liquid), such as IPA. Additionally, in the organic solvent treatment, the controller 3 controls the electric motor 23 to maintain a rotational state of the spin base 21 (substrate rotating step). The substrate W is rotated at, for example, 400 rpm during the organic solvent treatment. The heater unit 6 is disposed at the first separation position. The second movable nozzle 12 retreats to the home position beside the cup 8. The chemical solution valve 43 and the inert-gas valves 38 and 44 are controlled so as to be in a closed state. Therefore, the second movable nozzle 12 does not discharge an inert gas (for example, nitrogen gas).

With reference to FIG. 6 and FIG. 7B, in the water-repellent-agent treatment, the controller 3 controls the first nozzle-moving unit 15 to maintain a state in which the first movable nozzle 11 is placed at the center position. The controller 3 opens the water-repellent-agent valve 40 to supply a water repellent agent from the first movable nozzle 11 to the upper surface of the substrate W. After replacing the IPA on the upper surface of the substrate W with the water repellent agent, the controller 3 maintains an open state of the water-repellent-agent valve 40 to keep supplying the water repellent agent to the upper surface of the substrate W. As a result, a liquid film 95 of the water repellent agent (first organic solvent) is formed on the upper surface of the substrate W (liquid-film forming step). Additionally, in the water-repellent-agent treatment, the controller 3 controls the electric motor 23 to maintain a rotational state of the spin base 21 (substrate rotating step). The substrate W is rotated at, for example, 200 rpm during the water-repellent-agent treatment. The second movable nozzle 12 is kept in a state in which it has retreated to the home position beside the cup 8. The chemical solution valve 43 and the inert-gas valves 38 and 44 are kept in a closed state.

The controller 3 opens the volatile-organic-solvent valve 52 to start the supply of a volatile organic solvent (second organic solvent), such as IPA, to the facing surface 6*a* of the heater unit 6 from the lower surface nozzle 9 (volatile organic solvent supplying step, second organic solvent supplying step). Thereafter, the controller 3 controls the raising/lowering unit 7 to move the heater unit 6 to the second separation position. The supply of a water repellent agent to the upper surface of the substrate W, the supply of a volatile organic solvent to the facing surface 6*a* of the heater unit 6, and the movement of the heater unit 6 toward the second separation position are started in this order. As a result, the entirety of the substrate W is evenly heated in a state in which the water repellent agent sufficiently spreads across the entirety of the upper surface of the substrate W. Therefore, the treatment performed with the water repellent agent is restrained from becoming uneven in the upper surface of the substrate W. The supply of a water repellent agent to the upper surface of the substrate W, the supply of a volatile organic solvent to the facing surface 6*a* of the heater unit 6, and the movement of the heater unit 6 toward the second separation position are not necessarily required to be started in this order. The supply of a water repellent agent, the supply of a volatile organic solvent, and the movement of the heater unit 6 may be different in starting order from those in the present preferred embodiment. Additionally, the supply of a water repellent agent, the supply of a volatile organic solvent, and the movement of the heater unit 6 may be simultaneously started.

The volatile organic solvent, such as IPA, that is supplied from the lower surface nozzle 9 to the facing surface 6*a* is, for example, liquid formed. A volatile organic solvent that lands on the facing surface 6*a* spreads from a central area of the facing surface 6*a* that is a periphery of the discharge port 9*a* toward an outer periphery of the facing surface 6*a*. In that case, the volatile organic solvent also enters a concave portion 65 formed at the facing surface 6*a*. The central area of the facing surface 6*a* is an area around the center of the facing surface 6*a* including a position that crosses with the rotational axis A1 in the facing surface 6*a*.

A liquid formed volatile organic solvent (second organic solvent) on the facing surface 6*a* is vaporized by being heated by the heater unit 6 (volatile organic solvent vaporizing step, second organic solvent vaporizing step). The vapor of a volatile organic solvent is formed by vaporizing a liquid formed volatile organic solvent. The vapor of a volatile organic solvent formed on the facing surface 6*a* is supplied to the space 70 between the facing surface 6*a* and the lower surface of the substrate W (vapor supplying step). The vapor of a volatile organic solvent is higher in temperature than the boiling point of the volatile organic solvent. On the other hand, the substrate W is heated to about 30° C. by heating by use of radiant heat. It is possible to heat the substrate more efficiently than in a case in which the substrate is heated by use of radiant heat, by supplying the vapor of a volatile organic solvent capable of heating the substrate W higher than 30° C. to the space.

As thus described, the lower surface nozzle 9 serving as a volatile-organic-solvent nozzle (second organic solvent nozzle) that supplies a liquid formed volatile organic solvent (second organic solvent) to the space 70, and the heater unit 6 are constitute of a volatile organic-solvent supplying unit (second organic-solvent supplying unit) that supplies the vapor of a volatile organic solvent (second organic solvent) to the space 70. Even if the lower surface nozzle 9 supplies misty IPA to the space 70 unlike the present preferred embodiment, the lower surface nozzle 9 and the heater unit 6 are constitute of the volatile organic-solvent supplying unit (second organic-solvent supplying unit) in the same way as in the present preferred embodiment.

By continuously performing the supply of the liquid volatile organic solvent to the facing surface 6*a* and the heating of the liquid volatile organic solvent by means of the heater unit 6, the liquid volatile organic solvent is successively vaporized, and the space 70 is filled with the vapor of the volatile organic solvent. Part of the vaporized volatile organic solvent flows from the space 70 to the substrate W and to a side (radially outer side) of the heater unit 6. An airflow of the vaporized volatile organic solvent restrains a water repellent agent that has scattered from the upper surface of the substrate W because of a centrifugal force from flowing around toward the lower surface of the substrate W.

The substrate W whose upper surface is continuously supplied with a water repellent agent and that is in a rotational state is heated by supplying the vapor of a volatile organic solvent to the space 70. In other words, in parallel with the substrate rotating step and the liquid-film forming step, the substrate W being in a rotational state is heated by the vapor of a volatile organic solvent (second organic solvent), such as IPA (substrate heating step). At this time, the vapor of the volatile organic solvent (second organic solvent) may be continuously heated by the heater unit 6 (vapor heating step). Additionally, the substrate W may be heated by radiant heat emitted from the facing surface 6*a* of the heater unit 6 in addition to the heating by means of the vapor of the volatile organic solvent.

In the dry treatment (S6), the substrate being in a rotational state is heated by the vapor of a volatile organic solvent (second organic solvent), such as IPA (substrate heating step), and then the liquid film 95 of a water repellent agent (first organic solvent) is excluded from the substrate W, and the upper surface of the substrate W is dried in a state in which the rotation of the substrate W is stopped and the substrate W has been brought into contact with the heater unit 6 (substrate drying step).

In detail, in the substrate drying step, a rinse step T1, a puddle step T2, a lift puddle step T3, a nozzle replacing step T4, an opening forming step T5, and an opening enlarging step T6 are performed in this order.

The rinse step T1 is a step in which a low-surface-tension liquid, such as IPA, is supplied to the upper surface of the substrate W while rotating the substrate W. In the rinse step T1, IPA is supplied from the first movable nozzle 11 to the upper surface of the substrate W with reference to FIG. 6 and FIG. 7C. The low-surface-tension liquid supplied thereto receives a centrifugal force to flow outwardly from the center of the upper surface of the substrate W, and forms a liquid film 90 with which the upper surface of the substrate W is covered (second liquid-film forming step). The whole area of the upper surface of the substrate W is covered with the liquid film 90, and, as a result, the water repellent agent supplied to the upper surface of the substrate W is all replaced with a low-surface-tension liquid by means of the water-repellent-agent treatment (S6 of FIG. 5), and a liquid film 95 of the water repellent agent is excluded from the upper surface of the substrate W.

The substrate W is rotated by the spin chuck 5 at, for example, about 300 rpm during the rinse step T1. The first movable nozzle 11 is placed at the center position that faces the rotational center of the substrate W. The low-surface-tension liquid valve 37 is brought into an open state, and, accordingly, a low-surface-tension liquid, such as IPA, discharged from the first movable nozzle 11 is supplied toward the rotational center of the upper surface of the substrate W from above. The heater unit 6 is positionally controlled to be placed higher than the lower position, and is maintained at, for example, the second separation position. The second movable nozzle 12 is maintained in a state in which the second movable nozzle 12 has receded to the home position beside the cup 8. The chemical solution valve 43 and the inert-gas valve 44 are each controlled to be in a closed state.

After starting the rinse step T1, i.e., after ending the supply of the water repellent agent to the upper surface of the substrate W, the controller 3 may maintain the volatile-organic-solvent valve 52 to be in an open state for a predetermined period of time (for example, for a period from the start to the end of the rinse step T1). As a result, for a period from the start to the end of the rinse step T1, supplying of the vapor of a volatile organic solvent, such as IPA, to the space 70 between the lower surface of the substrate W and the facing surface 6*a* of the heater unit 6 is continued. Therefore, an airflow of the vaporized volatile organic solvent can restrain a water repellent agent that has scattered from the upper surface of the substrate W because of a centrifugal force from flowing around toward the lower surface of the substrate W. It is possible to further restrain the water repellent agent that has scattered from the upper surface of the substrate W because of a centrifugal force from flowing around toward the lower surface of the substrate W by continuously supplying the vapor of the volatile organic solvent to the space 70 until the end of the rinse step T1.

Figure 7D:
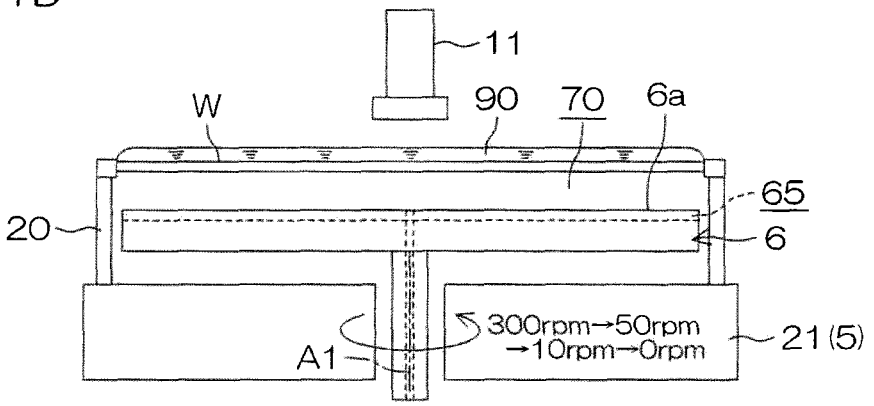

The puddle step T2 is a step of decelerating and stopping the rotation of the substrate W, and forming a thick liquid film 90 of a low-surface-tension liquid, such as IPA, on the front surface of the substrate W, and holding the liquid film 90 as shown in FIG. 7D.

With reference to FIG. 6 and FIG. 7D, the rotation of the substrate W is stepwisely decelerated from the rotation speed in the rinse step T1 in this example (deceleration step, gradual deceleration step, stepwise deceleration step). More specifically, the rotation speed of the substrate W is decelerated from 300 rpm to 50 rpm, and is maintained for a predetermined time (for example, ten seconds), and thereafter is decelerated to 10 rpm, and is maintained for a predetermined time (for example, ten seconds), and thereafter is decelerated to 0 rpm (stop), and is maintained for a predetermined time (for example, ten seconds) (rotation stopping step). On the other hand, the first movable nozzle 11 is held at the center position, and continuously, a low-surface-tension liquid is discharged toward the rotational center of the upper surface of the substrate W. The low-surface-tension liquid is discharged from the first movable nozzle 11 continuously for the entire period of the puddle step T2. In other words, even if the substrate W is stopped, the low-surface-tension liquid is continuously discharged. As thus described, the low-surface-tension liquid is never lost throughout the upper surface of the substrate W by supplying the low-surface-tension liquid continuously for the entire period from the deceleration to the stop of the rotation of the substrate W. Additionally, it is possible to form a thick liquid film 90 on the upper surface of the substrate W by supplying the low-surface-tension liquid continuously after the stop of the rotation of the substrate W.

The position of the heater unit 6 in the puddle step T2 is the same as in the rinse step T1, and is the second separation position. Thus, the substrate W is preheated by radiant heat emitted from the facing surface 6*a*. After the rotation of the substrate W is stopped, the chuck pin 20 is changed from a closed state to an open state while a stopped state of the substrate W is being kept. As a result, the chuck pin 20 supports the lower surface of the peripheral edge portion of the substrate W from below without grasping the peripheral edge portion of the substrate W. Therefore, the whole area of the upper surface of the substrate W is opened. The position of the second movable nozzle 12 is still the home position. The chemical solution valve 43, the inert-gas valves 38 and 44, and the water-repellent-agent valve 40 are each controlled to be in a closed state.

Figure 7E:
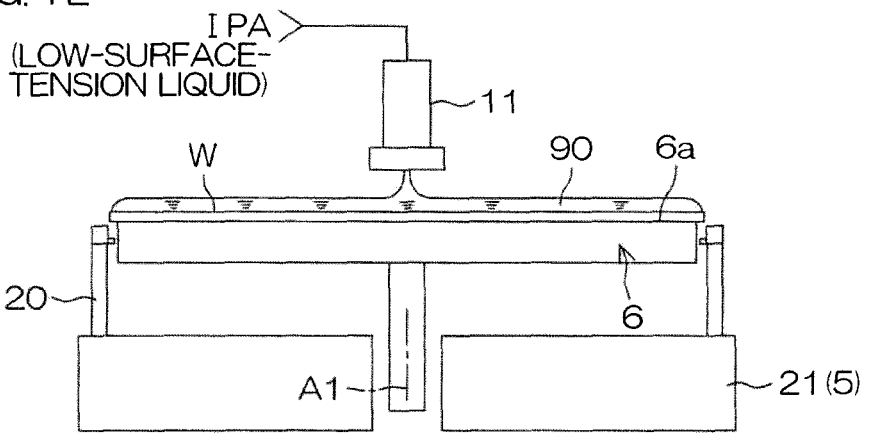

The lift puddle step T3 is a step of holding a liquid film 90 of a low-surface-tension liquid on the upper surface of the substrate W while heating the substrate W in a state in which the substrate W is being lifted by the heater unit 6, i.e., in a state in which the facing surface 6*a* is in contact with the lower surface of the substrate W as shown in FIG. 7E.

With reference to FIG. 6 and FIG. 7E, the controller 3 controls the electric motor 23 to maintain a state in which the rotation of the substrate W is being stopped (rotation stopping step). In order to bring the facing surface 6*a* into contact with the lower surface of the substrate W being in a rotation stopped state, the controller 3 raises the heater unit 6, and allows the heater unit 6 to approach the lower surface of the substrate W (heater-unit moving step). The heater unit 6 is raised from the second separation position to the upper position, and is held for a predetermined time (for example, ten seconds). In a process in which the heater unit 6 is raised to the upper position, the substrate W is delivered from the chuck pin 20 to the facing surface 6*a*, and the lower surface of the substrate W comes into contact with the facing surface 6*a* (heater-unit contact step). Discharging of the low-surface-tension liquid from the first movable nozzle 11 is continued until a point between the beginning and the end of the lift puddle step T3. Therefore, the low-surface-tension liquid is being continuously supplied when the amount of heat given to the substrate W is increased (amount-of-heat increasing step) resulting from the fact that the facing surface 6*a* of the heater unit 6 comes into contact with the lower surface of the substrate W and the fact that the substrate W starts to be rapidly heated by heat conduction from the facing surface 6*a*. This makes it possible to avoid the fact that the liquid film 90 of the low-surface-tension liquid is holed at unspecific positions because of the evaporation of IPA resulting from a rapid rise in temperature of the substrate W. The supply of the low-surface-tension liquid is stopped after the lapse of a predetermined time after the facing surface 6*a* of the heater unit 6 comes into contact with the lower surface of the substrate W (i.e., after the amount-of-heat increasing step is completed) (supply stopping step). In other words, the controller 3 closes the low-surface-tension liquid valve 37 to stop discharging the low-surface-tension liquid from the first movable nozzle 11.

In the lift puddle step T3, the rotation of the spin chuck 5 is being stopped. The second movable nozzle 12 is placed at the home position. The chemical solution valve 43, the inert-gas valves 38 and 44, and the water-repellent-agent valve 40 are each in a closed state. The first movable nozzle 11 is placed above the rotational center of the substrate W.

The heater unit 6 is held at the upper position until a predetermined time elapses after the supply of the low-surface-tension liquid from the first movable nozzle 11 is stopped. The low-surface-tension liquid supplied to the upper surface of the substrate W is pushed toward the outer peripheral side by means of a new low-surface-tension liquid supplied to the center, and is heated and is raised in temperature by means of heat emitted from the upper surface of the substrate W heated by the heater unit 6 in its process. The temperature of the low-surface-tension liquid at the central area of the upper surface of the substrate W is comparatively low during a period of time during which the low-surface-tension liquid is continuously supplied. Therefore, it is possible to raise the temperature of the low-surface-tension liquid at the central area of the upper surface of the substrate W by keeping the contact state of the heater unit 6 only for a predetermined short time after stopping the supply of the low-surface-tension liquid. As a result, it is possible to uniform the temperature of the liquid film 90 of the low-surface-tension liquid supported on the upper surface of the substrate W.

Evaporation occurs in an interface between the upper surface of the substrate W and the liquid film 90 that has received heat from the upper surface of the substrate W. As a result, a vapor phase layer made of a gas of the low-surface-tension liquid is generated between the upper surface of the substrate W and the liquid film 90. Therefore, the liquid film 90 reaches a state of being supported on the vapor phase layer in the whole area of the upper surface of the substrate W (vapor phase layer forming step).

Figure 7F:
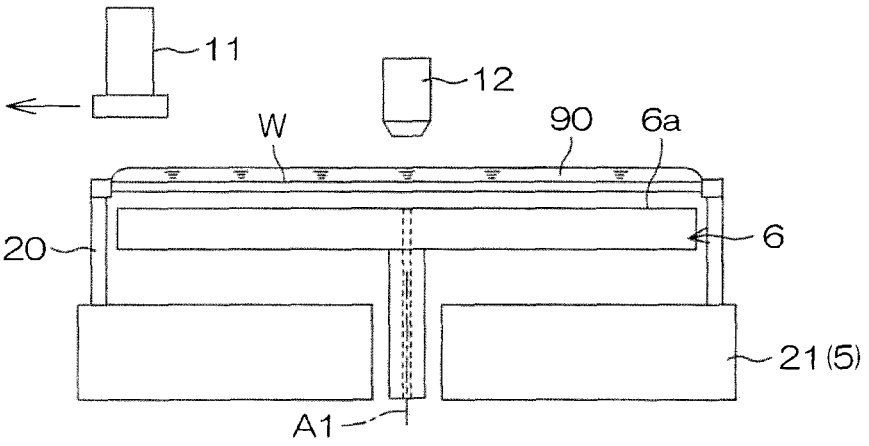

The nozzle replacing step T4 is a step of retracting the first movable nozzle 11 from the center position and, instead, placing the second movable nozzle 12 at the center position as shown in FIG. 7F. In detail, with reference to FIG. 6 and FIG. 7F, after the supply of the low-surface-tension liquid is stopped, the first movable nozzle 11 is retracted to a home position that has been set beside the cup 8. Thereafter, the second movable nozzle 12 is moved from the home position to the center position on the rotational axis A1. The heater unit 6 is moved down slightly lower than the upper position during the nozzle replacing step T4. Accordingly, the substrate W is delivered from the heater unit 6 to the chuck pin 20, and the facing surface 6*a* faces the lower surface of the substrate W in a noncontact state with an interval between the facing surface 6*a* and the lower surface of the substrate W. As a result, the heating of the substrate W is changed to heating performed by radiant heat emitted from the facing surface 6*a*, and the amount of heat given to the substrate W decreases (amount-of-heat decreasing step). This makes it possible to avoid the fact that the substrate W is overheated while the nozzle is replaced with another. Additionally, the occurrence of cracks of the liquid film 90 caused by evaporation (particularly, cracks in the outer peripheral region of the substrate W) can be avoided.

The liquid film 90 of the low-surface-tension liquid is excluded from the upper surface of the substrate W by performing the opening forming step T5 and the opening enlarging step T6 (excluding step). The excluding step includes an opening forming step that forms an opening 91 in the liquid film 90 by supplying an inert gas to the central area of the liquid film 90 and an opening enlarging step that excludes the liquid film 90 from the upper surface of the substrate W by enlarging the opening 91. The central area of the liquid film 90 is an area around the center of the liquid film 90 including a position that crosses with the rotational axis A1 in the liquid film 90.

Figure 7G:
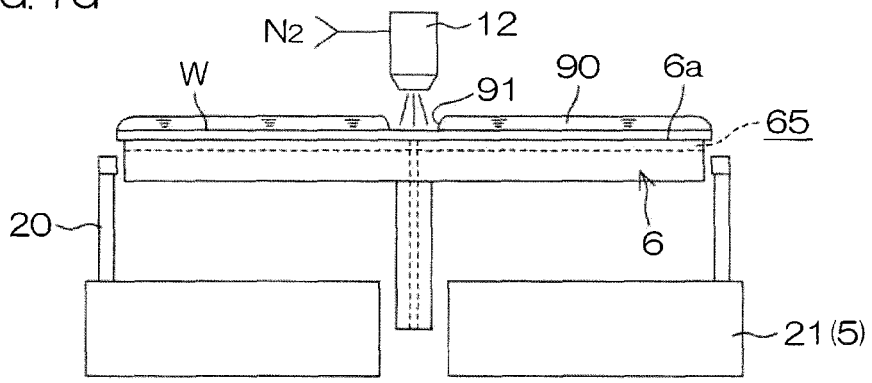

The opening forming step T5 is a step of boring a small opening 91 in the central area of the liquid film 90 of the low-surface-tension liquid to expose the central area of the upper surface of the substrate W as shown in FIG. 7G by blowing (i.e., supplying) an inert gas (for example, nitrogen gas) at a small flow rate (first flow rate. e.g., 3 liter/minute) from the second movable nozzle 12 (inert-gas supplying unit) toward the central area of the liquid film 90 (opening forming step). In the opening forming step T5, the rotation of the substrate W is still in a stopped state. Therefore, the opening forming step T5 is applied to the liquid film 90 on the substrate W being in a stationary state.

With reference to FIG. 6 and FIG. 7G, the controller 3 opens the inert-gas valve 44, and controls the opening degree of the flow-rate variable valve 45. As a result, an inert gas (for example, nitrogen gas) is discharged from the second movable nozzle 12 at a small flow rate (first flow rate. e.g., 3 liter/minute). The heater unit 6 is raised substantially simultaneously with the discharge of the inert gas. As a result, the facing surface 6*a* comes into contact with the lower surface of the substrate W, and the substrate W is lifted by the heater unit 6 (heater-unit moving step).

Therefore, the amount of heat given from the heater unit 6 to the substrate W is small at a point in time where the inert gas reaches the upper surface of the substrate W, and therefore it is possible to lessen a temperature difference between the upper and lower surfaces of the substrate W caused by the cooling of the substrate W by use of the inert gas and by the heating by use of the heater unit 6. This makes it possible to avoid a warp in the substrate W caused by a temperature difference between the upper and lower surfaces of the substrate W. If the heater unit 6 is brought into contact with the lower surface of the substrate W when an inert gas is supplied, there is a possibility that the temperature on the upper surface side of the substrate W will become lower than the temperature on the lower surface side thereof, and the substrate W will be warped so that the upper surface side of the substrate W becomes hollow. In this case, in the upper surface of the substrate W, its central part becomes lower whereas its peripheral edge part becomes higher. Therefore, the outward movement of the liquid film 90 is obstructed. Therefore, in the present preferred embodiment, an inert gas is supplied to the center of the upper surface of the substrate W in a state in which the heater unit 6 has been separated from the lower surface of the substrate W. As a result, a temperature difference between the upper and lower surfaces of the substrate W is lessened.

On the other hand, the substrate W starts to be rapidly heated immediately after the formation of the opening 91 (i.e., substantially simultaneously) (amount-of-heat-increasing repeating step). As a result, the substrate W starts to be swiftly heated (substantially simultaneously) when the liquid film 90 starts to be moved outwardly by forming the opening 91 by use of an inert gas. Accordingly, the liquid film 90 is moved toward the outside of the substrate W without being stopped.

More specifically, in the central area in which the liquid film 90 having the opening 91 has been lost, the temperature of the substrate W rises more swiftly than in an area around the central area in which the liquid film 90 is present. As a result, a great temperature gradient is generated inside the substrate W in the peripheral edge of the opening 91. In other words, the inside of the peripheral edge of the opening 91 is higher in temperature whereas the outside thereof is lower in temperature. The liquid film 90 supported on a vapor phase layer is started moving toward the low-temperature side, i.e., to start moving outwardly due to this temperature gradient, and, as a result, the opening 91 at the center of the liquid film 90 is enlarged.

In this way, the opening 91 is enlarged, and the liquid film 90 on the substrate W is excluded outwardly from the substrate W while using the temperature gradient generated by heating the substrate W (opening enlarging step, liquid-film moving step). More specifically, in the upper surface of the substrate W, the liquid film 90 in an area in which a pattern is formed is excluded by the movement of the low-surface-tension liquid caused by the temperature gradient.

When the heater unit 6 is brought into contact with the substrate W with a long interval of time after forming the opening 91 at the rotational center of the substrate W by blowing an inert gas, the enlargement of the opening 91 is stopped during that time. At this time, the inner peripheral edge of the liquid film 90 reaches an equilibrium state in which the inner peripheral edge moves inwardly or outwardly. At this time, there is a possibility that a liquid surface of an organic solvent will enter the inside of a pattern formed on the front surface of the substrate W so as to cause a pattern collapse by means of surface tension. Therefore, in the present preferred embodiment, by bringing the heater unit 6 into contact with the lower surface of the substrate W substantially simultaneously with the formation of the opening 91 by use of an inert gas, the amount of heat given to the substrate W is instantaneously increased.

Figure 7H:
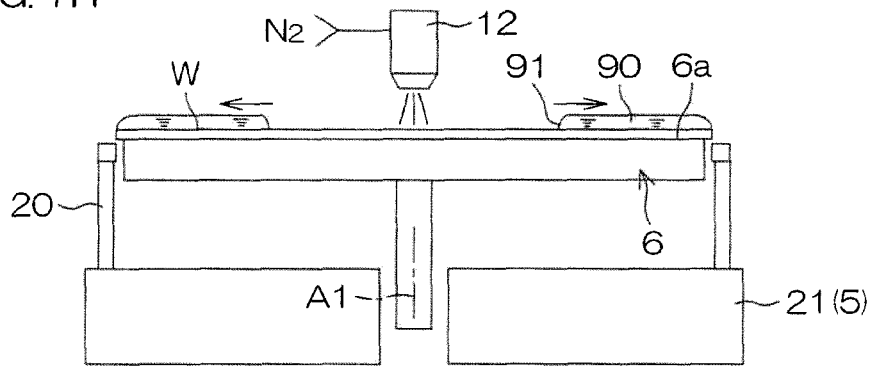

The opening enlarging step T6 is a step of enlarging the opening 91 at the center of the liquid film 90 by means of the inert gas, by increasing the flow rate of an inert gas discharged from the second movable nozzle 12 and blowing the inert gas having a large flow rate (second flow rate. e.g., 30 liter/minute) onto the center of the substrate W, and further as shown in FIG. 6 and FIG. 7H (opening enlarging step). In other words, the controller 3 controls the flow-rate variable valve 45 to increase the flow rate of an inert gas supplied to the second movable nozzle 12. As a result, the liquid film 90 that has moved to an outer peripheral area of the upper surface of the substrate W is further pushed outwardly from the substrate W. The rotation of the substrate W is kept in a stopped state.

In detail, in a process in which the opening 91 spreads because of a temperature gradient, the flow rate of the inert gas is further increased. This makes it possible to avoid stopping the movement of the liquid film 90 and to continuously move the liquid film 90 outwardly from the substrate W. If the liquid film 90 moves merely by use of the temperature gradient, there is a possibility that the movement of the liquid film 90 will stop in the peripheral edge area of the upper surface of the substrate W. Therefore, the movement of the liquid film 90 is assisted by increasing the flow rate of the inert gas. As a result, the liquid film 90 is excluded from the whole area of the upper surface of the substrate W.

After increasing the flow rate of the inert gas, the heater unit 6 is lowered, and the substrate W is delivered from the facing surface 6*a* to the chuck pin 20. Thereafter, the chuck pin 20 is brought into a closed state and the substrate W is grasped by the chuck pin 20, before the discharge of the inert gas whose flow rate is large is ended. In the example shown in FIG. 6, after the substrate W is delivered to the chuck pin 20, the heater unit 6 is held for a short time at a noncontact heating position at which the heater unit 6 faces the lower surface of the substrate W with a slight interval therebetween, and thereafter the heater unit 6 is further lowered, and is placed at the first separation position at which the heater unit 6 faces the lower surface of the substrate W with a predetermined interval therebetween.

After the substrate W is grasped by the chuck pin 20, the supply of the inert gas to the second movable nozzle 12 is stopped, and the second movable nozzle 12 recedes to the home position. Simultaneously, the substrate W is rotated together with the spin chuck 5 at, for example, 30 to 100 rpm. As a result, IPA, which remains in the outer peripheral portion (particularly, the peripheral end surface) of the substrate W without being excluded even by supplying a large flow of inert gas, is spun off.

According to the first preferred embodiment, in the substrate heating step, the substrate W is heated by the vapor of a volatile organic solvent (second organic solvent), such as IPA, supplied to the space 70 between the facing surface 6*a* of the heater unit 6 and the lower surface of the substrate W. The vapor of the volatile organic solvent is capable of more efficiently heating the substrate W than radiant heat emitted from the heater unit 6. Therefore, even if the heater unit 6 does not come into contact with the substrate W, the substrate W can be heated sufficiently. In other words, the substrate W being in a rotational state is sufficiently heated. As a result, partial exposure of the upper surface of the substrate W, which results from the partial evaporation of the liquid film 95 of a water repellent agent (first organic solvent), is restrained. Therefore, the liquid film 95 of the water repellent agent can be formed excellently. Therefore, it is possible to excellently process the upper surface of the substrate W by means of the water repellent agent.

On the other hand, in the substrate drying step, the upper surface of the substrate W can be dried in a state in which the rotation of the substrate W has been stopped and in which the heater unit 6 has been brought into contact with the substrate W. As a result, the substrate W is sufficiently heated. Therefore, the substrate W can be dried excellently.

As described above, the substrate W can be processed by use of a water repellent agent (first organic solvent) excellently and can be dried excellently.

Additionally, according to the first preferred embodiment, the vapor of a volatile organic solvent (second organic solvent) supplied to the space 70 is heated by the heater unit 6. Therefore, the substrate W by use of the vapor of the volatile organic solvent can be heated efficiently.

Additionally, according to the first preferred embodiment, in the liquid-film forming step, a water repellent agent that raises the water repellency of the upper surface of the substrate W is supplied from the first movable nozzle 11 (water-repellent-agent supplying unit, first organic-solvent supplying unit) to the upper surface of the substrate W. The liquid film 95 of the water repellent agent is comparatively easily divided. Therefore, in order to hold the liquid film 95 on the upper surface of the substrate W, the substrate W is required to be rotated. Therefore, in the substrate heating step, the substrate W being in a rotational state is heated, and therefore the upper surface of the substrate W is excellently processed by the water repellent agent.

Additionally, according to the first preferred embodiment, a volatile organic solvent (second organic solvent) that is higher in volatility than water is supplied to the space 70 between the facing surface 6*a* of the heater unit 6 and the lower surface of the substrate W. Therefore, the volatile organic solvent supplied to the space 70 is easily maintained in a vapor state. Therefore, the vapor of the volatile organic solvent supplied to the space 70 is restrained from being liquefied. As a result, the volatile organic solvent is restrained from adhering to the substrate, and therefore it is possible to excellently dry the substrate W.

Additionally, according to the first preferred embodiment, a liquid formed or misty volatile organic solvent (second organic solvent) is supplied to the space 70, and hence is heated by the heater unit 6. The liquid formed or misty volatile organic solvent is vaporized by this heating. Therefore, a vapor for heating the substrate W being in a rotational state can be supplied by use of the heater unit 6 to the space 70.

Unlike the first preferred embodiment, in an arrangement in which a pre-vaporized volatile organic solvent is supplied to the space 70, it is necessary to install a heater in the volatile-organic-solvent supply pipe 50 or in a volatile-organic-solvent supply source. Alternatively, it is necessary to contain a gaseous volatile organic solvent having a larger volume than a liquid one in the volatile organic solvent supply source. Therefore, the arrangement of the substrate processing apparatus 1 is complicated. On the other hand, in an arrangement in which a liquid formed or misty volatile organic solvent is supplied to the space 70 as in the first preferred embodiment, a heater is not required to be provided besides the heater unit 6. Additionally, in the arrangement of the first preferred embodiment, it is possible to contain a liquid volatile organic solvent in the organic solvent supply source. Therefore, the substrate W can be processed excellently with an organic solvent by use of the substrate processing apparatus 1 having a simple arrangement and can be dried excellently.

Additionally, according to the first preferred embodiment, a volatile organic solvent (second organic solvent) is supplied from the lower surface nozzle 9 toward the facing surface 6*a* of the heater unit 6. Therefore, the volatile organic solvent is easily heated by the heater unit 6. Therefore, the vaporization of a liquid formed or misty volatile organic solvent is facilitated. Therefore, a vapor for heating the substrate W being in a rotational state can be supplied to the space 70 while efficiently using the heater unit 6.

Additionally, according to the first preferred embodiment, in the substrate drying step, the liquid film 95 of a water repellent agent is excluded from the upper surface of the substrate W, and the liquid film 90 of IPA is formed on the upper surface of the substrate W by supplying a low-surface-tension liquid, such as IPA, from the first movable nozzle 11 (low-surface-tension supplying unit) to the upper surface of the substrate W. Surface tension that acts on the upper surface of the substrate W can thereby be reduced. Therefore, the substrate W can be dried excellently by excluding the liquid film 90 of the low-surface-tension liquid from the upper surface of the substrate W.

Additionally, according to the first preferred embodiment, the opening 91 can be formed without leaving liquid droplets in the central area of the liquid film 90 of the low-surface-tension liquid by supplying an inert gas to the central area of the liquid film 90 of the low-surface-tension liquid. By enlarging the opening 91 and by excluding the liquid film 90 of IPA from the upper surface of the substrate W, the upper surface of the substrate W can be dried excellently.

Additionally, according to the first preferred embodiment, it is possible to allow the heater unit 6 to approach the lower surface of the substrate W to bring the facing surface 6*a* into contact with the lower surface of the substrate W by relatively moving the heater unit 6 to the spin chuck 5. Therefore, switching between a state in which the heater unit 6 is in contact with the substrate W and a state in which the heater unit 6 has been separated from the substrate W, can be performed reliably (easily). Therefore, when the substrate W is processed by a water repellent agent (first organic solvent), the substrate W being in a rotational state can be heated by use of the vapor of a volatile organic solvent (second organic solvent) in a state in which the heater unit 6 is reliably separated from the substrate W. Additionally, when the substrate W is dried, the substrate W can be heated in a state in which the heater unit 6 is reliably in contact with the substrate W.

Additionally, according to the first preferred embodiment, the concave portion 65 is disposed on the facing surface 6*a* of the heater unit 6. Therefore, the surface area of the facing surface 6*a* is made larger than in a case in which the facing surface 6*a* is flat. Therefore, the heater unit 6 can further facilitate the vaporization of a liquid formed or misty volatile organic solvent (second organic solvent), such as IPA, supplied to the space 70.

Additionally, according to the first preferred embodiment, the discharge port 9*a* of the lower surface nozzle 9 that is a facing-surface nozzle is exposed to the facing surface 6*a* of the heater unit 6. Therefore, the lower surface nozzle 9 can supply a volatile organic solvent (second organic solvent), such as IPA, to the space 70 between the facing surface 6*a* and the lower surface of the substrate W reliably.

Additionally, unlike the substrate processing of the first preferred embodiment, in a case in which a water repellent agent having the same composition as the first organic solvent is used for the volatile organic solvent (second organic solvent), the processing of the substrate W by use of the water repellent agent (first organic solvent) is not obstructed even if the vapor of the water repellent agent (second organic solvent) flows around toward the upper surface side of the substrate W when the substrate W is heated by the vapor of the water repellent agent (second organic solvent). Therefore, the upper surface of the substrate W can be processed by means of the water repellent agent (first organic solvent) excellently.

Second Preferred Embodiment

Figure 8:
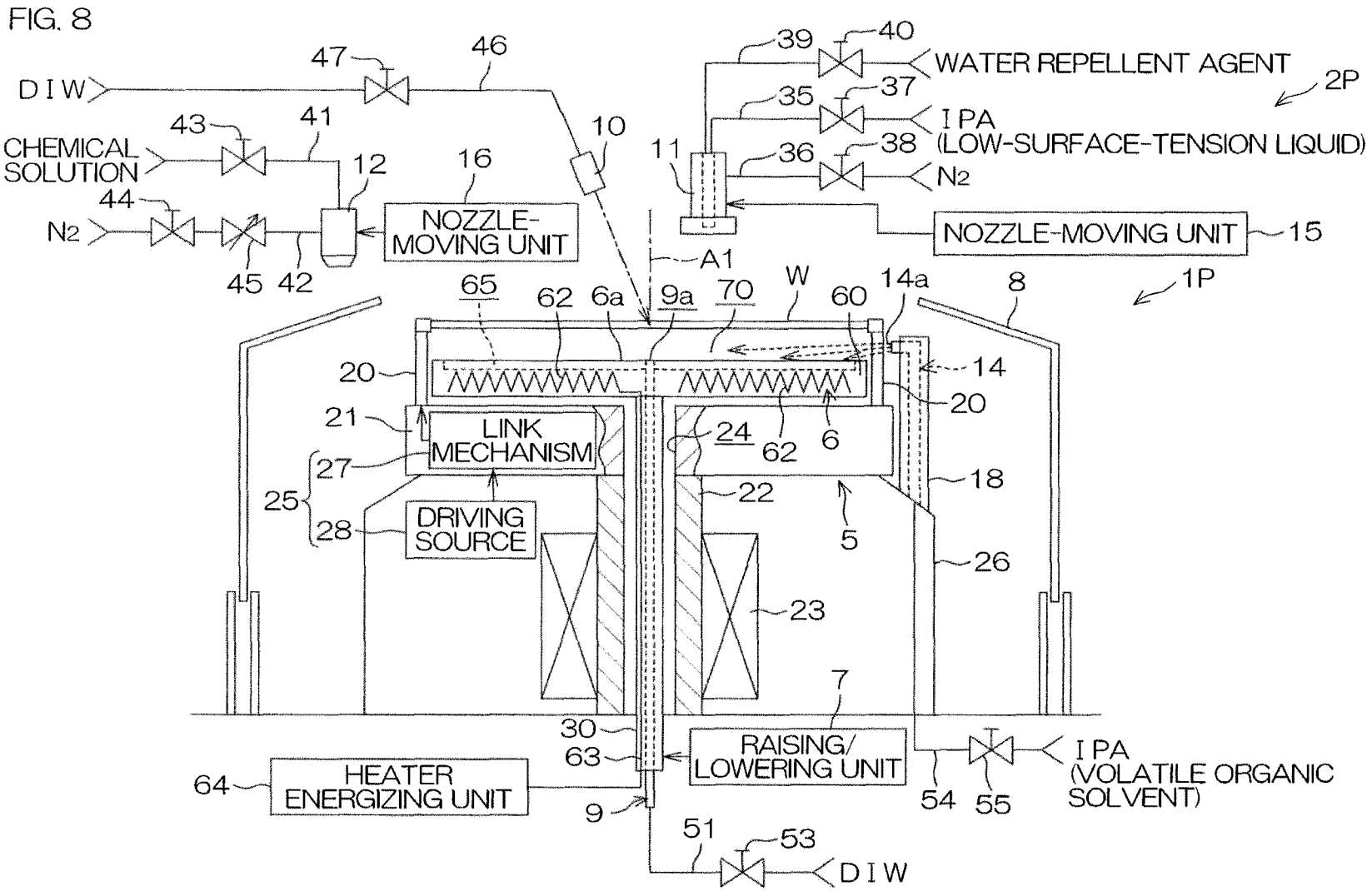
FIG. 8 is an illustrative partial cross-sectional view to describe an arrangement example of a processing unit included in a substrate processing apparatus according to a second preferred embodiment of the present invention.

FIG. 8 is an illustrative cross-sectional view to describe an arrangement example of a processing unit 2P included in a substrate processing apparatus 1P according to a second preferred embodiment of the present invention.

The processing unit 2P according to the second preferred embodiment chiefly differs from the processing unit 2 (see FIG. 2) according to the first preferred embodiment in the fact that the processing unit 2P includes a lateral nozzle 14 disposed beside the heater unit 6. The lateral nozzle 14 is inserted into and supported by, for example, the inside of a lateral-nozzle supporting member 18. The lateral nozzle supporting member 18 extends upwardly from the housing 26 that surrounds the rotational shaft 22 and the electric motor 23 below the spin base 21. The lateral nozzle 14 disposed beside the spin base 21 has a discharge port 14*a* that faces the facing surface 6*a* of the heater unit 6 at its upper end portion.

In the present preferred embodiment, the lateral nozzle 14 has a function as a volatile organic solvent supplying unit that supplies the vapor of a volatile organic solvent, such as IPA, higher in volatility than water to the space 70 between the facing surface 6*a* of the heater unit 6 and the lower surface of the substrate W. In the second preferred embodiment, the volatile organic solvent supplied by the lateral nozzle 14 is an example of the second organic solvent, and the lateral nozzle 14 is an example of the second organic-solvent supplying unit that supplies the second organic solvent to the upper surface of the substrate W.

A volatile-organic-solvent supply pipe 54 is joined to the lateral nozzle 14. A volatile-organic-solvent valve 55 that opens and closes a flow passage of the pipe is interposed in the volatile-organic-solvent supply pipe 54. On the other hand, the volatile-organic-solvent supply pipe 50 is not joined to the lower surface nozzle 9. Therefore, a volatile organic solvent is not discharged from the discharge port 9*a* of the lower surface nozzle 9.

The lateral nozzle 14 supplies a misty volatile organic solvent to the space 70 between the facing surface 6*a* of the heater unit 6 and the lower surface of the substrate W. In detail, the lateral nozzle 14 supplies a misty volatile organic solvent toward the facing surface 6*a* of the heater unit 6. The lateral nozzle 14 is an example of the second organic solvent nozzle that supplies a misty second organic solvent to the space 70 toward the facing surface 6*a*. Unlike the present preferred embodiment, the lower surface nozzle 9 may be arranged to supply a liquid volatile organic solvent to the space 70. Additionally, the lower surface nozzle 9 may be arranged to supply a liquid volatile organic solvent toward the facing surface 6*a*.

In the substrate processing apparatus 1P of the second preferred embodiment, it is possible to perform substrate processing in the same way as in the substrate processing apparatus 1 of the first preferred embodiment. In the substrate processing performed by the substrate processing apparatus 1P, the controller 3 controls the volatile-organic-solvent valve 55 joined to the lateral nozzle 14.

According to the second preferred embodiment, the same effect as in the first preferred embodiment is fulfilled, and therefore it is possible to excellently process the substrate W by use of a water repellent agent (first organic solvent), such as IPA, and it is possible to excellently dry the substrate W. Additionally, according to the second preferred embodiment, it is possible to provide a nozzle (lateral nozzle 14) that supplies a second organic solvent by using a space beside the heater unit 6.

The present invention is not limited to the preferred embodiments described above, and can be embodied in still other modes.

For example, in the substrate processing apparatuses 1 and 1P according to the aforementioned preferred embodiments, the water repellent agent supplied by the first movable nozzle 11 has been described as a first organic solvent, and the first movable nozzle 11 has been described as a first organic-solvent supplying unit that supplies the first organic solvent to the upper surface of the substrate W. However, unlike these preferred embodiments, the low-surface-tension liquid supplied by the first movable nozzle 11 may be a first organic solvent to process the upper surface of the substrate W. In this case, as in the aforementioned preferred embodiments, the first movable nozzle 11 is an example of the first organic-solvent supplying unit that supplies the first organic solvent to the upper surface of substrate W. In this case, in the substrate processing apparatuses 1 and 1P, the first movable nozzle 11 is not necessarily required to have a function as the water-repellent-agent supplying unit that supplies a water repellent agent to the upper surface of the substrate W. In other words, the first movable nozzle 11 may be arranged to have a function as the low-surface-tension liquid supplying unit that supplies a low-surface-tension liquid, such as IPA, whose surface tension is lower than water to the upper surface of the substrate W and a function as the inert-gas supplying unit that supplies an inert gas, such as nitrogen gas, to the upper surface of the substrate W.

If the first movable nozzle 11 is an example of the first organic-solvent supplying unit that supplies a low-surface-tension liquid (for example, IPA) as the first organic solvent to the upper surface of the substrate W, the organic solvent treatment (S4) and the water-repellent-agent treatment (S5) are not necessarily required to be performed (see FIG. 5) in the substrate processing performed by the substrate processing apparatuses 1 and 1P. In this case, in the rinse step T1 of the dry treatment (S6) (see FIG. 6 and FIG. 7C), DIW supplied to the upper surface of the substrate W in the DIW rinse treatment (S3) is replaced with a low-surface-tension liquid instead of replacing a water repellent agent with a low-surface-tension liquid, such as IPA. During the rinse step T1, the vapor of a volatile organic solvent (for example, IPA) as a second organic solvent is supplied to the lower surface of the substrate W.

Likewise, in the present preferred embodiment, the same effect as in the first preferred embodiment is fulfilled.

Additionally, according to the present preferred embodiment, in a case where both the low-surface-tension liquid (first organic solvent) and the volatile organic solvent (second organic solvent) are organic solvents (for example, IPA) each of which has the same composition, even if the vapor of the second organic solvent flows around toward the upper surface side of the substrate W when the substrate W is heated by the vapor of the second organic solvent, the processing of the substrate W by use of the first organic solvent is not obstructed. Therefore, it is possible to excellently process the upper surface of the substrate W by means of the first organic solvent.

Additionally, in the substrate processing apparatuses 1 and 1P according to the aforementioned preferred embodiments, the vapor of IPA has been described as being supplied to the space 70 by supplying a liquid formed or misty volatile organic solvent (second organic solvent) to the facing surface 6*a* of the heater unit 6, and heating liquid formed or misty volatile organic solvent to be vaporized by the heater unit 6. However, unlike these preferred embodiments, the lower surface nozzle 9 or the lateral nozzle 14 may be arranged to supply the vapor of a volatile organic solvent (second organic solvent) toward the space 70. In this case, the heater unit 6 is not included in the second organic-solvent supplying unit that supplies the vapor of the second organic solvent to the space 70, and the second organic-solvent supplying unit includes the lower surface nozzle 9 or the lateral nozzle 14 as its constituent element.

Additionally, in the aforementioned preferred embodiments, the vapor of a volatile organic solvent (second organic solvent) may be continuously supplied from the lower surface nozzle 9 to the space 70 until the puddle step T2 of the drying step (S6 of FIG. 5) is completed.

Additionally, in the aforementioned preferred embodiments, the first movable nozzle 11 has been described as functioning as a volatile organic solvent supplying unit and as a low-surface-tension liquid supplying unit. However, unlike the aforementioned preferred embodiments, a nozzle that functions as a volatile organic solvent supplying unit and a nozzle that functions as a low-surface-tension liquid supplying unit may be arranged to be provided independently of each other.

Additionally, in the aforementioned preferred embodiment, the second movable nozzle 12 has been described as supplying an inert gas to the central area of the liquid film 90 of IPA. However, unlike the aforementioned preferred embodiment, the first movable nozzle 11 may be arranged to supply an inert gas to the central area of the liquid film 90 of IPA. In this case, in the dry treatment (S6 of FIG. 5) of substrate processing, the nozzle replacing step T4 is excluded.

Additionally, in the aforementioned preferred embodiment, an arrangement in which the heater unit 6 relatively moves with respect to the spin chuck 5 has been described. However, unlike the aforementioned preferred embodiment, a substrate W held by the spin chuck 5 may be arranged to be moved raising/lowering.

The present application corresponds to Japanese Patent Application No. 2016-187248 filed on Sep. 26, 2016 in the Japan Patent Office, and the entire disclosure of the present application is incorporated herein by reference.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A substrate processing method comprising:

a substrate holding step of horizontally holding a substrate;

a substrate rotating step of rotating the substrate held horizontally around a rotational axis along a vertical direction;

a liquid-film forming step of forming a liquid film of a water repellent agent, which is used to process an upper surface of the substrate, by supplying the water repellent agent to the upper surface of the substrate held horizontally and rotated around the rotational axis;

a vapor supplying step of supplying a vapor of a first organic solvent to a space between a facing surface of a heater unit that has the facing surface facing a lower surface of the substrate held horizontally and the lower surface of the substrate;

a substrate heating step of heating the substrate that is in a rotational state by means of the vapor of the first organic solvent supplied to the space, in parallel with the substrate rotating step and the liquid-film forming step; and a substrate drying step of, after the substrate heating step, excluding the liquid film of the water repellent agent from the substrate held horizontally by replacing the liquid film of the water repellent agent on the upper surface of the substrate held horizontally with a liquid film of a second organic solvent, and drying the substrate by excluding the liquid film of the second organic solvent from the upper surface of the substrate in a state in which the rotation of the substrate is stopped and the substrate is in contact with the heater unit, wherein the water repellent agent is a silicon-based water repellent agent that hydrophobizes silicon itself or a compound including silicon, or a metal-based water repellent agent that hydrophobizes metal itself or a compound including metal, the silicon-based water repellent is a silane coupling agent including at least one selected from the group consisting of HMDS (hexamethyldisilazane), TMS (tetramethylsilane), fluoridated alkylchlorosilane, alkyldisilazane, and a non-chloro-based water repellent agent, the non-chloro-based water repellent agent including at least one selected from the group consisting of dimethylsilyldimethylamine, dimethylsilyldiethylamine, tetramethyldisilazane, bis(dimethylamino)dimethylsilane, N,N-dimethylaminotrimethylsilane, N-(trimethylsilyl)dimethylamine, and an organosilane compound, the metal-based water repellent agent includes at least one amine that has a hydrophobic group and an organic silicon compound, the first organic solvent includes a volatile organic solvent that is higher in volatility than water, the first organic solvent being a liquid including at least one selected from the group consisting of IPA (isopropyl alcohol), HFE (hydrofluoroether), methanol, ethanol, acetone, trans-1,2-dichloroethylene, and the water repellent agent, and the second organic solvent is a low-surface-tension liquid whose surface tension is lower than water, and is a liquid that includes at least one selected from the group consisting of IPA (isopropyl alcohol), HFE (hydrofluoroether), methanol, ethanol, acetone, and trans-1,2-dichloroethylene.

2. The substrate processing method according to claim 1, wherein the substrate heating step includes a step of heating the vapor of the first organic solvent that is supplied to the space, by means of the heater unit.

3. The substrate processing method according to claim 1, wherein the vapor supplying step includes a first organic solvent supplying step of supplying the first organic solvent that is liquid formed or misty to the space, and a first organic solvent vaporizing step of vaporizing the first organic solvent that is liquid formed or misty by heating the first organic solvent that is liquid formed or misty by means of the heater unit.

4. The substrate processing method according to claim 1, wherein the excluding step of the liquid film of the second organic solvent in the drying step includes:

an opening forming step of forming an opening in the liquid film of the second organic solvent by supplying an inert gas to a central area of the liquid film of the second organic solvent; and an opening enlarging step of excluding the liquid film of the second organic solvent from the upper surface of the substrate by enlarging the opening.

5. The substrate processing method according to claim 1, wherein the substrate drying step includes a heater-unit moving step of allowing the heater unit to approach the lower surface of the substrate in order to bring the facing surface into contact with the lower surface of the substrate being in a state in which the rotation has been stopped.

6. The substrate processing method according to claim 1, wherein a composition of the first organic solvent is identical with a composition of the second organic solvent.

7. The substrate processing method according to claim 3, wherein the first organic solvent supplying step includes a step of supplying the first organic solvent that is liquid formed or misty toward the facing surface of the heater unit.

* * * * *